US006174658B1

(12) United States Patent
Yamazaki

(10) Patent No.: US 6,174,658 B1
(45) Date of Patent: Jan. 16, 2001

(54) SILVER HALIDE LIGHT-SENSITIVE PHOTOGRAPHIC MATERIAL

(75) Inventor: Katsumasa Yamazaki, Odawara (JP)

(73) Assignee: Konica Corporation (JP)

( * ) Notice: Under 35 U.S.C. 154(b), the term of this patent shall be extended for 0 days.

(21) Appl. No.: 09/185,207

(22) Filed: Nov. 3, 1998

(30) Foreign Application Priority Data

Nov. 4, 1997 (JP) ..... 9-316652
Feb. 13, 1998 (JP) ..... 10-048854

(51) Int. Cl.[7] ..... G03C 1/83
(52) U.S. Cl. ..... 430/517; 430/933; 430/631
(58) Field of Search ..... 430/517, 631, 430/933, 522

(56) References Cited

U.S. PATENT DOCUMENTS

| | | | | |
|---|---|---|---|---|
| 263,990 | | 5/1882 | Kendall et al. . | |
| 4,894,313 | * | 1/1990 | Neumann et al. | 430/271 |
| 4,894,321 | * | 1/1990 | Ogawa et al. | 430/933 |
| 5,230,991 | * | 7/1993 | Nagaoka et al. | 430/393 |
| 5,922,525 | * | 7/1999 | Garnsey et al. | 430/576 |

FOREIGN PATENT DOCUMENTS

| | | |
|---|---|---|
| 230715 | 4/1944 | (CH) . |
| 4 25 258 | 5/1991 | (EP) . |
| 4 83 416 | 5/1992 | (EP) . |
| 6 10 994 | 8/1994 | (EP) . |
| 4511111 | 4/1970 | (JP) . |
| 4537376 | 11/1970 | (JP) . |
| 4830495 | 9/1973 | (JP) . |
| 50111641 | 9/1975 | (JP) . |
| 50145125 | 11/1975 | (JP) . |
| 5147043 | 12/1976 | (JP) . |
| 5220830 | 2/1977 | (JP) . |
| 53117 | 1/1978 | (JP) . |
| 61-151650 | 7/1986 | (JP) . |
| 61148448 | 7/1986 | (JP) . |
| 62-275562 | 11/1987 | (JP) . |
| 62-283336 | 12/1987 | (JP) . |
| 481783 | 12/1992 | (JP) . |
| WO 88 07703 | 10/1988 | (WO) . |

OTHER PUBLICATIONS

European Search Report EP 98 30 8994.

* cited by examiner

*Primary Examiner*—Janet Baxter
*Assistant Examiner*—Amanda C. Walke
(74) *Attorney, Agent, or Firm*—Jordan B. Bierman; Bierman, Muserlian and Lucas

(57) ABSTRACT

Disclosed is a silver halide photographic light sensitive material which has each of at least one silver halide photographic light sensitive emulsion layer and non-lightsensitive hydrophilic colloid layer, and solid fine particles of compound demonstrating fluorescent whitening effect in at least one of the silver halide photographic light sensitive emulsion layer and non-lightsensitive hydrophilic colloid layer.

A silver halide photographic light sensitive material having an image excellent in sharpness and improved in whiteness and bright value of print is provided.

10 Claims, No Drawings

SILVER HALIDE LIGHT-SENSITIVE PHOTOGRAPHIC MATERIAL

FIELD OF THE INVENTION

The present invention relates to a silver halide light-sensitive photographic material, and more specifically to a silver halide light-sensitive photographic material for direct appreciation, which exhibits improvement in whiteness and lightness of the printed white background and further, excellent image sharpness.

BACKGROUND OF THE INVENTION

In order to enhance the whiteness of a white background after processing, application of a fluorescent whitening agent is a well-known technique. Acceptable visual whiteness varies depending on personal preference. However, generally, it is known that white tinted with blue looks more white than achromatic white. In order to prepare such white, the application of the fluorescent whitening agent is an important technique.

In recent years, a silver halide light-sensitive photographic material has been required which can be applied to simple and quick processing. Particularly, in a silver halide light-sensitive color photographic material, color photographic processing has been increasingly simpler and quicker, and quick processability and stability in processing have also been required. Particularly, in color photographic paper which is highly required to achieve quick development, as an applied silver halide emulsion, an application technique of a silver halide emulsion having a high content ratio of silver chloride, which exhibits improved developability, has been developed to markedly shorten processing time.

Furthermore, in view of environmental protection, the decrease in processing solution wastes is strongly required for processing of sliver halide light-sensitive materials. Due to this, a continual decrease in the replenishment rate of processing solutions has been progressed.

However, in such quick processing carried out in a short period of time and at a low replenishment rate, residual staining due to sensitizing dyes and other dyes, is likely to occur. Under such conditions, improvement in whiteness employing a fluorescent whitening effect becomes increasingly important in order to provide photographic paper which produces a pleasing appearance of prints.

Needless to say, of course, irrespective of the presence of residual staining, the florescent whitening method is generally employed to improve visual perceived whiteness.

Such fluorescent whitening methods known in the art include, for example, methods in which a fluorescent whitening agent is incorporated into the paper support or a polyethylene laminated layer thereof, as disclosed in Japanese Patent Publication Open to Public Inspection No. 53-117, U.S. Pat. Nos. 3,449,257, 3,501,298, and 3,558,316,; furthermore, methods in which a water-soluble fluorescent whitening agent is directly added to a silver halide emulsion layer or another photographic coating constituting layer, as described in Japanese Patent Publication No. 48-30495, etc.; or methods in which an oil-soluble fluorescent whitening agent is dissolved in a high boiling point organic solvent, is emulsify-dispersed, and the resulting dispersion is added, as described in U.K. Patent No. 1,072,915, U.S. Pat. No. 2,322,027, Japanese Patent Publication No. 4-81783, etc.; and methods in which a polymer in which a fluorescent whitening agent is mixed is added, or a fluorescent whitening agent is dissolved and dispersed at the same time when a photographic dispersing agent such as a coupler, etc. is dispersed and added; or for example, a fluorescent whitening agent such as a water-soluble diaminostilbene series derivative is previously added to the developing solution and the fluorescent whitening agent penetrates into the light-sensitive material, as disclosed in Japanese Patent Publication Nos. 45-37376, 45-11111, and 51-47043, and U.S. Pat. Nos. 3,416,923 and 3,418,127.

However, in the case of polyethylene-laminated paper suitable for quick processing, when a fluorescent whitening agent intends to be contained in the laminated layer, defects result such that during the thermal extrusion process at the formation of the lamination layer, the fluorescent whitening agent is easily decomposed, or due to insufficient heat resistant sublimating properties of a fluorescent whitening agent, the adhesion to equipment causes production problems. In addition, in this method, in order to prepare many types of light-sensitive materials to meet application requirements, the amount of the fluorescent whitening agent to be added requires adjustment over a long time, increases labor and cost, and due to the limitation for the application, only a few are employed for production.

In the method in which a water-soluble fluorescent whitening agent is added to a silver halide emulsion layer or other photographic coating constituting layers, defects are caused such that the age n t is dissolved out to a developing solution and whiteness is not improved as expected, and whiteness varies in accordance with processing conditions.

In order to minimize the outflow to a developing solution, a method was considered in which, after an oil-soluble fluorescent whitening agent was dissolved in a high boiling point organic solvent, the addition was carried our upon emulsifying and dispersing the resulting. However, defects were caused such that sufficient whiteness was not obtained due to an insufficient whitening effect, or during production or storage, whiteness was degraded due to the deposition or decomposition, and in addition, staining resulted occasionally.

Furthermore, the method, in which a fluorescent whitening agent was previously added to the developing solution, caused problems such that when the amount necessary for obtaining a sufficient fluorescent whitening effect was added, the fluorescent whitening agent deposited during the elapse of time and the deposited agent adhered to a light-sensitive material to degrade the quality.

As mentioned above, at present, techniques for improvement in whiteness employing a fluorescent whitening agent result in no sufficient effect to the silver halide light-sensitive photographic material.

Hence, investigation has been carried out and it has been found that the above-mentioned defects are improved by incorporating a fluorescent whitening agent as fine solid particles into a silver halide light-sensitive emulsion layer or a non-sensitive hydrophilic colloidal layer.

Furthermore, along with the proliferation of light-sensitive color photographic materials, requirements for quality images has been increasingly demanded in addition to the above-mentioned improvement in whiteness. In such situations, regarding the light-sensitive material for photographic color prints, investigations on color reproduction, tone reproduction, improvement in sharpness, improvement in uneven density, etc. have been conducted more widely than before.

As factors affecting sharpness, irradiation and halation have been generally known. The former is generated by the fact that incident light is scattered by silver halide grains or coupler droplets dispersed into a gelatin layer, and the degree thereof depends mainly on the amount of gelatin, the amount of silver halide, the amount of oil droplets, and furthermore, the latter depends on the amount of reflection light from a support, the reflectance and refractive index of the support.

Antiirradiation has been carried out for improvement in dyes. Techniques to improve these are described, for example, in Japanese Patent Publication Open to Public Inspection Nos. 50-145125, 52-20830, 50-111641, 61-148448, 61-151650, 62-275562, 62-283336, etc.

Regarding the minimization of halation, a method is known in which an antihalation layer is provided. Techniques for this improvement are described, for example, in Japanese Patent Publication Open to Public Inspection Nos. 55-33172, 59-193447, 62-33448, etc.

Based on these techniques, sharpness is improved. However, sensitivity is markedly decreased. It has been difficult to improve the sharpness, while maintaining sensitivity high enough for practical use.

Furthermore, it is known that sharpness is improved by incorporating black colloidal silver into a layer lower than the dye forming layer. However, when a large amount of colloidal silver is employed to markedly improve sharpness, the white background is deteriorated due to insufficient silver removal. It has been difficult to employ this technique to improve the sharpness.

As for the sharpness, deterioration is remarkable at longer wave length, especially infrared area. So, it is difficult to improve sharpness of a silver halide light sensitive material having infrared sensitivity, which has become popular.

Accordingly, an investigation has been conducted and it is found that by incorporating fine solid particles of a fluorescent whitening agent into a nonlight-sensitive hydrophilic colloidal layer provided in a specified position, excellent sharpness is obtained and the whiteness and lightness of a background are improved.

SUMMARY OF THE INVENTION

Accordingly, an object of the present invention is to provide a silver halide light-sensitive photographic material for direct appreciation, which exhibits excellent image sharpness, and improved lightness and whiteness of a printed white background.

The silver halide light-sensitive photographic material of the present invention and its embodiments are described below.

The silver halide light-sensitive photographic material comprises at least one light-sensitive silver halide emulsion layer and at least one nonlight-sensitive hydrophilic colloidal layer provided on a support. One of the light-sensitive silver halide emulsion layers or the nonlight-sensitive hydrophilic colloidal layer contains fine solid particles of a compound exhibiting a fluorescent whitening effect.

The silver halide light-sensitive photographic material may comprises a nonlight-sensitive hydrophilic colloidal layer provided between the light-sensitive silver halide emulsion layer nearest the support and the support.

The fine solid particles of a compound exhibiting a fluorescent whitening effect is preferably contained in the light sensitive layer or nonlight-sensitive hydrophilic colloidal layer provided between the light-sensitive silver halide emulsion layer nearest the support and the support.

White pigment is contained in a nonlight-sensitive hydrophilic colloidal layer provided between the light-sensitive silver halide emulsion layer nearest the support and the support. In one embodiment the white pigment is contained in the nonlight-sensitive hydrophilic colloidal layer provided between the light-sensitive silver halide emulsion layer nearest the support and the support in addition to the fine solid particles exhibiting a fluorescent whitening effect.

In another embodiment the white pigment is contained in another nonlight-sensitive hydrophilic colloidal layer provided between the support and the nonlight-sensitive hydrophilic colloidal layer containing the fine solid particles exhibiting a fluorescent whitening effect. So in this embodiment at least two nonlight-sensitive hydrophilic colloidal layers are provided between the light-sensitive silver halide emulsion layer nearest the support and the support, and one on which near to the support contains white pigment.

In the embodiment mentioned above, white pigment may be replaced by colloidal silver. In this instance, the colloidal silver may be contained in the nonlight-sensitive hydrophilic colloidal layer containing the fine solid particles exhibiting a fluorescent whitening effect, or another nonlight-sensitive hydrophilic colloidal layer provided between the support and the nonlight-sensitive hydrophilic colloidal layer containing the fine solid particles exhibiting a fluorescent whitening effect.

The light-sensitive silver halide emulsion of one of the light-sensitive silver halide emulsion layers may be spectrally sensitized by infrared spectral sensitizer. In this instance the light-sensitive silver halide emulsion layer contains yellow coupler.

The compound exhibiting a fluorescent whitening effect is an organic salt substantially water-insoluble. One of the preferable example is represented by the formula (I), $$A^{n-}n(B^{+}) \quad \text{(I)}$$

wherein A represents a fluorescent whitening agent component having an anionic group; B. represents an organic cation having total carbon atoms of not less than 15, and n represents an integer of 1 to 9.

Another preferable example of the compound exhibiting a fluorescent whitening effect is a substantially water-insoluble organic salt, represented by the formula (II), $$C^{n-}n(D^{+}) \quad \text{(II)}$$

wherein C represent a fluorescent whitening agent component having a sulfonic acid group; D represents an organic cation having total carbon atoms of not less than 15, and n represents an integer of 1 to 9.

DETAILED DESCRIPTION OF THE INVENTION

The present invention will be explained in detail below.

Compounds exhibiting a fluorescent whitening effect employed in the present invention are those which are substantially insoluble in water and exhibit the desired fluorescent whitening effect. Any compound may be employed, if it is substantially insoluble both in water oil, and exhibits the fluorescent whitening effect at normal temperatures. Substantially insoluble in water as described herein denotes that solubility is not more than 1.0 g per 100 g of pure water at 25° C.

As the substantially water-insoluble compounds exhibiting a fluorescent whitening effect, ordinary water insoluble fluorescent whitening agents can be employed. The water-insoluble organic salts represented by the general formula (I) are preferred and the substantially water-insoluble organic salts represented by the general formula (II) are more preferred.

General formula (I)

$$A^{n-}n(B^{+})$$

wherein A represents a fluorescent whitening agent component having an anionic group such as, for example, a carboxyl group, etc.; B represents a organic cation group having total carbon atoms of not less than 15 such as, for example, ammonium, pyridinium, etc., and n represents an integer of 1 to 9.

As the above-mentioned fluorescent whitening agent components having an anionic group, substituted stilbene series fluorescent whitening agents having an anionic group, substituted coumarin series fluorescent whitening agents, and substituted thiophene series fluorescent whitening agents are preferred.

General formula (II)

$$C^{n-}n(D^{+})$$

wherein C represents a fluorescent whitening agent component having a sulfonic acid group; D represents a organic cation group such as, for example, ammonium, pyridinium, etc., having total carbon atoms of not less than 15 and n represents an integer of 1 to 9.

As the above-mentioned fluorescent whitening agent components having a sulfonic acid group, substituted stilbene series fluorescent whitening agents having a sulfonic acid group, substituted coumarin series fluorescent whitening agents, and substituted thiophene series fluorescent whitening agents are preferred.

The fluorescent whitening agent components of the present invention, represented by A of the general formula (I) and C of the general formula (II) can be readily synthesized with the reference to, for example, "Keikozohakuzai (Fluorescent Whitening Agents)" edited by Kagakuhin Kogyokai, U.K. Patent No. 920,988, German Patent No. 1,065,838, U.S. Pat. No. 2,610,152, etc.

The compounds represented by the general formulas (I) and (II), can be readily synthesized by mixing, for example, a fluorescent whitening agent component corresponding to A in the general formula (I) and C in the general formula (II) of the present invention with an organic cation such as ammonium, pyridinium, etc. having total carbon atoms of not less than 15, etc. corresponding to B in the general formula (I) and D in the general formula (II) of the present invention. As the organic cation, an ammonium ion having carbon atoms of not less than 15 is preferred.

As the ammonium ion having total carbon atoms of not less than 15 corresponding to B in the general formula (I) and D in the general formula (II) of the present invention, the ammonium cation represented by the general formula (III) described below is preferred.

General formula (III)

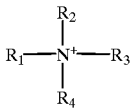

wherein $R_1$, $R_2$, $R_3$, and $R_4$ each represents an alkyl group or a phenyl group. The number of total carbon atoms in $R_1$, $R_2$, $R_3$, and $R_4$ are not less than 15 and preferably not more than 40.

The number of total carbon atoms in $R_1$, $R_2$, $R_3$, and $R_4$ is preferably not less than 20.

As the pyridinium cation having total carbon atoms of not less than 15 corresponding to B in the general formula (I) and D in the general formula (II) of the present invention, the pyridinium cation represented by the general formula (IV) described below is preferred.

General formula (IV)

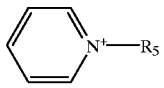

wherein $R_5$ represents an alkyl group or a phenyl group having carbon atoms of not less than 15 and preferably not more than 40.

The number of total carbon atoms in $R_5$ is preferably not less than 15.

Substantially water-insoluble compounds exhibitting a fluorescent whitening effect is preferably insoluble in oil.

Specific examples of substantially water-insoluble compounds employed in the present invention, which exhibit a fluorescent whitening effect, are listed below.

F-1

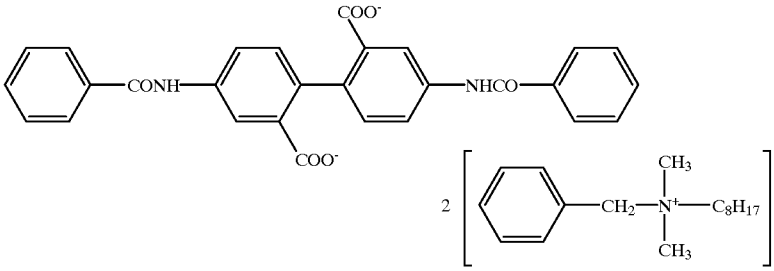

-continued
F-2
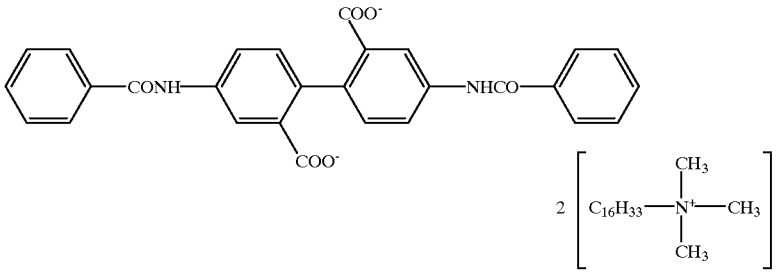
F-3
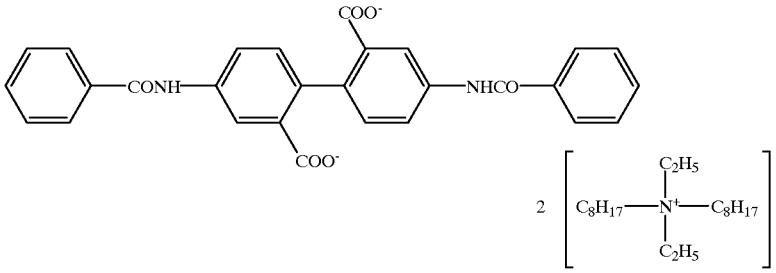
F-4
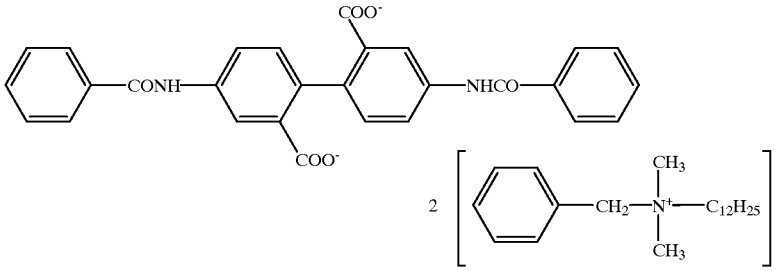
F-5
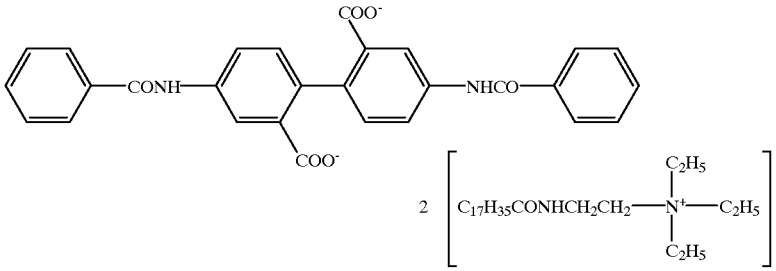
F-6
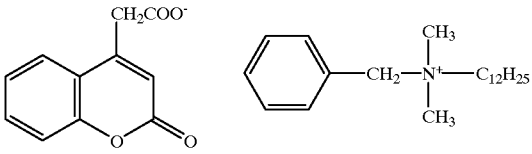
F-7
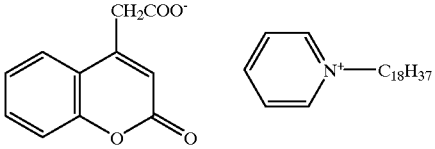

-continued
F-8
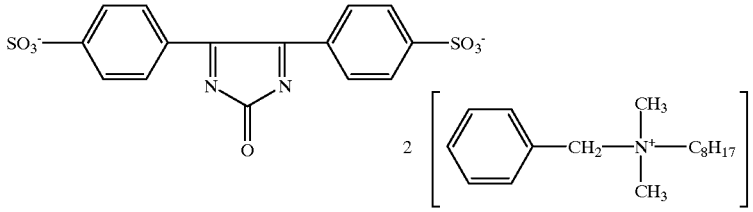
F-9
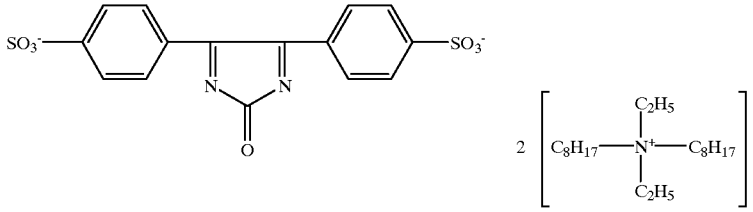
F-10
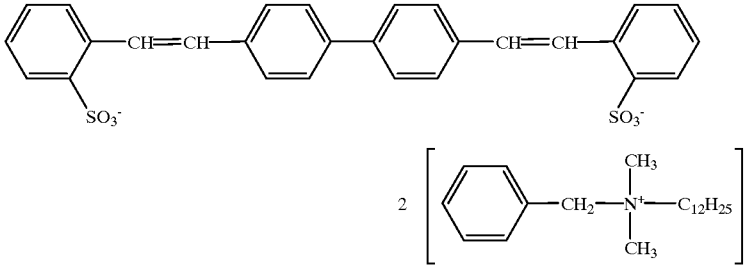
F-11
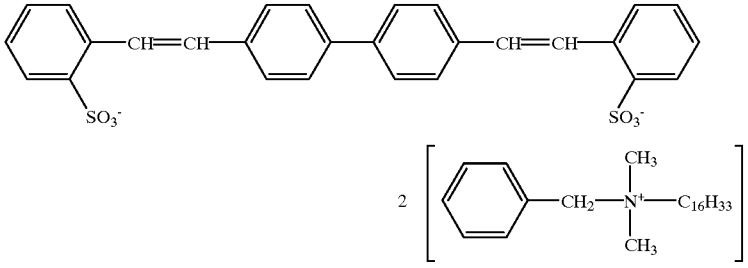
F-12
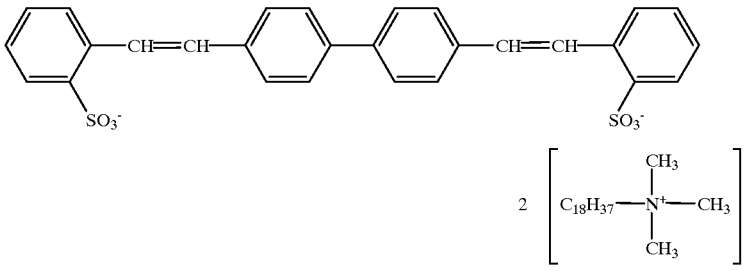
F-13
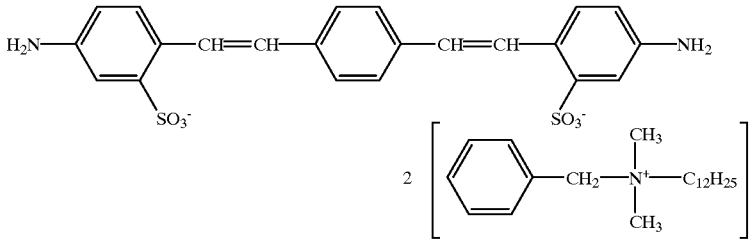

-continued
F-14
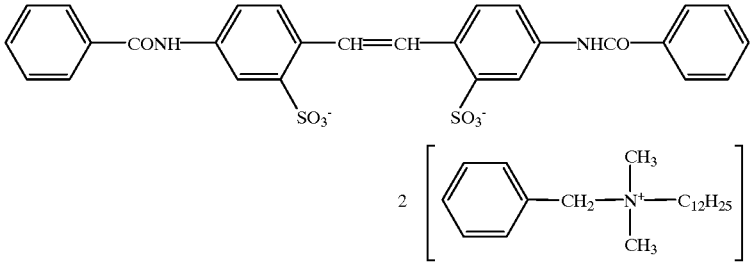
F-15
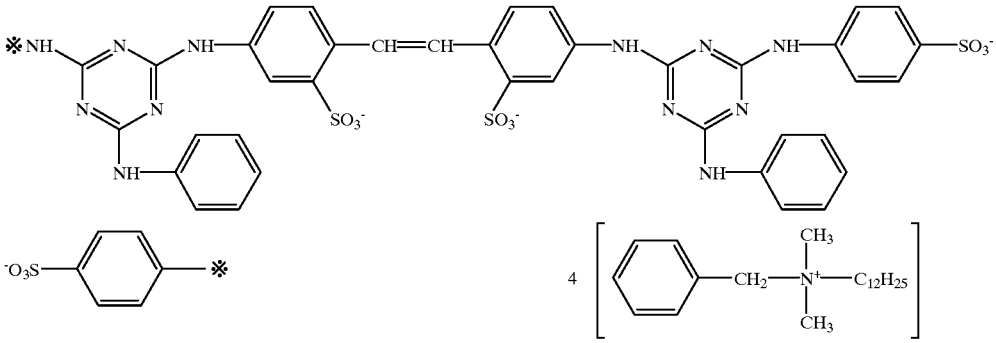
F-16
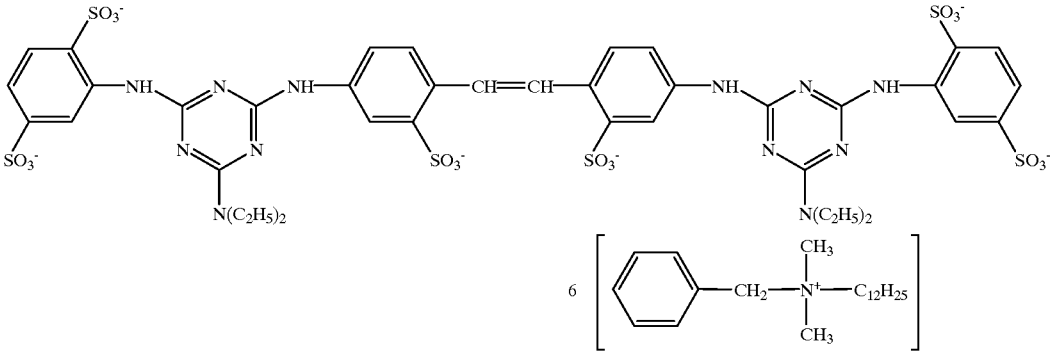
F-17
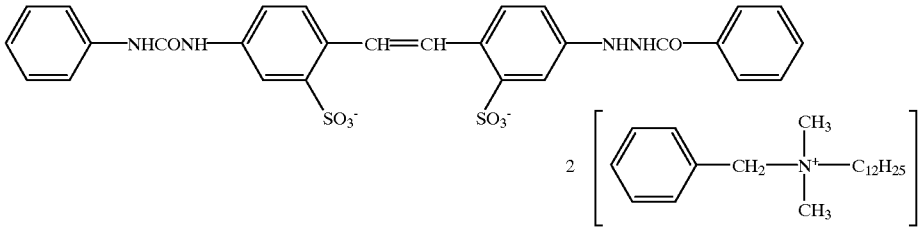
F-18
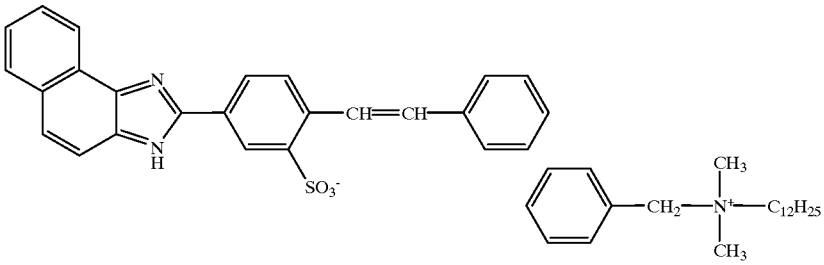

-continued

F-19

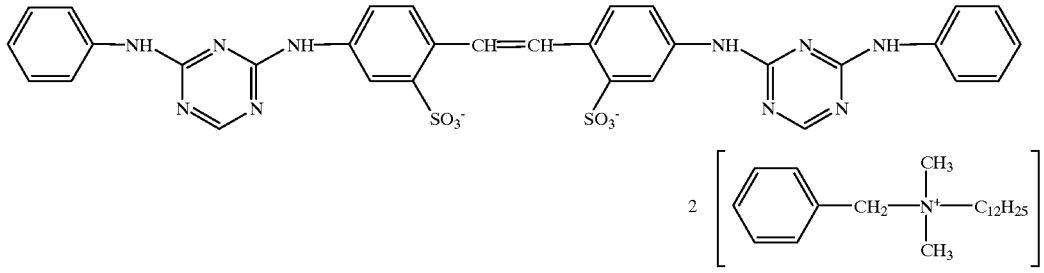

F-20

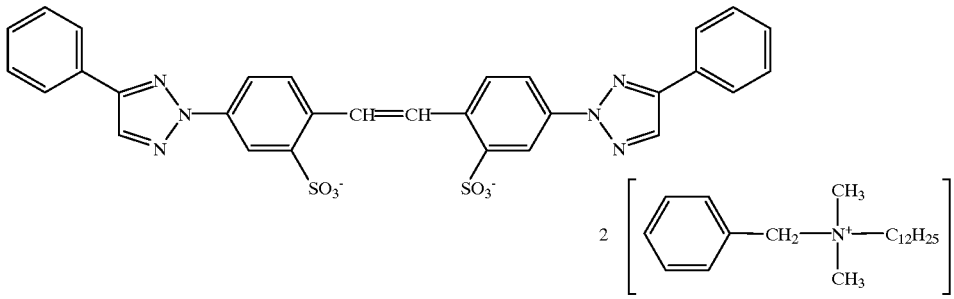

F-21

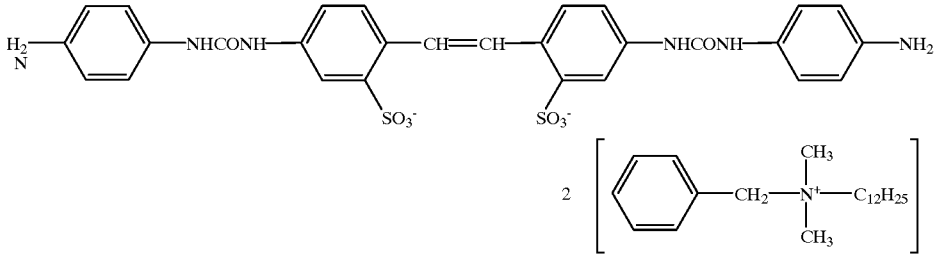

The compound exhibiting a fluorescent whitening effect is incorporated, as fine solid particles, into the layer constituting a silver halide light-sensitive photographic material.

The fine solid particles exhibiting a fluorescent whitening effect, is added, preferably in the form of a fine solid particle dispersion, especially suspension, to the layer constituting the silver halide light-sensitive photographic material.

The fine solid particles of the compound exhibiting a fluorescent whitening effect can be dispersed, for example, employing a method in which fine solid particles are dispersed into water or an aqueous hydrophilic colloidal solution such as a gelatin solution, etc.; a method in which a compound is dispersed into water or an aqueous hydrophilic colloidal solution such as a gelatin solution, etc. upon being pulverized employing a ball mill or a sand mill; a method in which a compound is dispersed into water or an aqueous hydrophilic colloidal solution such as a gelatin solution, etc. employing a homogenizer having strong shearing capability such as a Manton-Gaulin homogenizer, a method in which dispersion is carried out employing an ultrasonic homogenizer, etc.

When the compound exhibiting a fluorescent whitening effect is dispersed to prepare fine solid particles, in order to improve dispersibility and dispersion stability, a surface active agent can be employed. As preferred surface active agents, anionic surface active agents, nonionic surface active agents and betaine type amphoteric surface active agents are listed.

The average particle diameter of the fine solid particle dispersion of the compound exhibiting a fluorescent whitening effect is between 0.05 and 5 $\mu$m, preferably between 0.1 and 2 $\mu$m, and more preferably between 0.2 and 1 $\mu$m.

The compound exhibiting a fluorescent whitening effect may be incorporated into any layer constituting a silver halide light-sensitive photographic material. Incorporation into the nonlight-sensitive hydrophilic colloidal layer is preferred, and incorporation into at least one layer of the nonlight-sensitive hydrophilic colloidal layers provided between the silver halide emulsion layer nearest a support and the support itself is more preferred. An employed amount of the compound exhibiting a fluorescent whitening effect, is between 10 and 2,000 mg/m$^2$ of the silver halide light-sensitive photographic material and preferably between 50 and 1,000 mg/m$^2$.

Sharpness can be improved by incorporating the fine solid particles exhibiting a fluorescent whitening effect into the above-mentioned specified layer.

In order to improve sharpness, it is preferred that white pigment is incorporated into a nonlight-sensitive hydrophilic colloidal layer containing a compound exhibiting a fluorescent whitening effect, and further a nonlight-sensitive hydrophilic colloidal layer containing white pigment or colloidal silver is provided between the layer containing a compound exhibiting a fluorescent whitening effect and a support.

As the above-mentioned white pigments, can be employed, for example, rutile type titanium dioxide, anatase type titanium dioxide, barium sulfate, barium stearate, silica, alumina, zirconium oxide, kaolin, etc. Due to various reasons, of these, titanium dioxide is preferred. White pigment is dispersed into a water-soluble binder such as gelatin, etc. forming hydrophilic colloid so that the processing solution can penetrate, and coated as a white pigment layer.

The amount of the white pigment is preferably 0.05 to 50 $g/m^2$ and more preferably 0.1 to 20 $g/m^2$.

As water-soluble binders employed for a nonlight-sensitive hydrophilic colloidal layer containing a white pigment, gelatin is mainly employed. However, if desired, hydrophilic colloid such as other type gelatin, gelatin derivatives, graft polymers of gelatin with other polymers, protein other than gelatin, sugar derivatives, cellulose derivatives, synthesized hydrophilic copolymers such as single polymers or copolymers, etc. can be employed together with gelatin.

The void ratio of a nonlight-sensitive hydrophilic colloidal layer comprising a white pigment is preferably between 5 and 30 weight percent with respect to the nonlight-sensitive hydrophilic colloidal layer. The void ratio is obtained based on specific gravity, layer thickness, etc.

In addition to the white pigment, yellow, gray, blue, and black colloidal silver, inorganic colored pigment, organic colored pigment, dyes, etc. can be incorporated into a nonlight-sensitive hydrophilic colloidal layer.

Furthermore, as the above-mentioned colloidal silver, various types can be employed. However, in order to minimize diffused reflection of visible light on the surface of a support, black colloidal silver is preferably employed.

The amount of black colloidal silver is preferably 0.01 to 1.0 $g/m^2$ and more preferably 0.03 to 0.3 $g/m^2$.

A colorant can be incorporated into a nonlight-sensitive hydrophilic colloidal layer comprising white pigment or a hydrophilic colloidal layer provided between a nonlight-sensitive hydrophilic colloidal layer comprising a white pigment and a support itself. As colorants, can be employed yellow, gray, blue, and black colloidal silver, in addition, various filter dyes. As such light absorbing materials, those which only absorb the entire visible spectra region can be employed. Furthermore, those which selectively absorb light of some part region can be employed. If desired, selection can be carried out. The transmission of the colorant containing hydrophilic colloidal layer is preferably not more than 50% and most preferably not more than 30%.

As a support used for the silver halide photographic light-sensitive material, any materials can be used. Paper laminated with polyethylene and polyethylene terephthalate, paper support comprises natural pulp or synthetic pulp, a vinyl chloride sheet, propyrene which may contain a white pigment, polyethylene terephthalate support and a baryta paper can be used. Of these, a support having a water-proof resin laminated layer on both base paper is preferable. As a water-proof resin, polyethylene, polyethylene terephthalate or its copolymer are preferable. White pigment is applicable to the support.

As a white pigment used for a support, an inorganic and/or organic white pigment may be used. The preferable is an inorganic white pigment. For example, sulfates of an alkaline earth metal such as barium sulfate, carbonate of an alkaline earth metal such as calcium carbonate, silicas such as fine powder silicate and synthetic silicate salt, calcium silicate, alumna, alumna hydrate, titanium oxide, zinc oxide, talc and clay are used. The white pigment is preferably barium sulfate and titanium oxide.

The amount of white pigment contained in a water-proof resin layer on the surface of a support is preferably 13 wt % to 15 wt % of whole resin layer, from viewpoint of improving sharpness.

The degree of dispersion of the white pigment in a water-proof resin layer in paper support can be measured by a method described in Japanese Patent O.P.I. Publication No. 2-28640. When measured by means of aforesaid method, the degree of dispersion of white pigment is preferably 0.20 or less and more preferably 0.15 or less in terms of variation coefficient described in aforesaid specification.

In addition, in order to regulate spectral reflective density balance on the white background after being processed and to improve white background, it is preferable to add minute amount of blue-tinting agent or red-tinting agent such as ultramarine blue or an oil-soluble dye in a white pigment containing water-proof resin in the reflective support or in a hydrophilic colloidal layer coated.

The silver halide light sensitive photographic composing layers are coated on a support which may be subjected to corona discharge, UV ray irradiation and flame processing as necessary, directly or via subbing layer (one or two or more subbing layers may be provided thereon for improving properties such as adhesiveness of a support surface, anti-static property, dimension stability, anti-friction property, hardness, anti-halation property, friction properties and/or other properties).

The silver halide emulsion may have arbitrary halogen composition such as silver chloride, silver bromoiodide, silver bromochloroiodide and silver iodochloride. Substantially, silver bromochloride not containing silver iodide is preferable. In terms of rapid processability, the silver halide emulsion containing silver chloride of preferably 97 mol % or more and more preferably 98 to 99.99 mol %.

In order to obtain the silver halide emulsion used for the present invention, a silver halide emulsion having a portion where silver bromide is contained in high density. In this occasion, the portion where silver bromide is contained in high density may be epitaxy joint with silver halide grains or may form a so-called core/shell structure. In addition, it does not form a complete layer in which regions where composition is different partially may exist. Incidentally, composition may vary continuously or uncontinuously. It is specifically preferable that the portion where silver bromide is contained in high density is the vertex of crystal grains on the surface of silver halide grains.

In order to obtain the silver halide emulsion, it is advantageous to incorporate heavy metal ion. As a heavy metal ion capable of being used for aforesaid purpose, metals participating in 8th through 10th periodic law such as iron, iridium, platinum, palladium, nickel, rhodium, osmium, ruthenium and cobalt, transition metals participating in 12th periodic law such as zinc and mercury and each ion of lead, rhenium, molybdenum, gallium and chrome. Of these, metallic ions such as iron, iridium, platinum, ruthenium, gallium and osmium are preferable.

Aforesaid metallic ions may be added to the silver halide emulsion in forms of salt and complex salt.

When the above-mentioned heavy metal ions form a complex salt, as its ligand or ion, cyanide ion, thiocyanate ion, cyanate ion, chloride ion, bromide ion, iodide ion, nitrate ion, carbonyl and ammonia are cited. Of these, a cyanide ion, thiocyante ion, cyanate ion, chloride ion and bromide ion are preferable.

In order to incorporate a heavy metal ion in the silver halide emulsion, aforesaid heavy metal compound may add at an arbitrarily step including prior to forming the silver halide grains, during forming the silver halide grains and during physical ripening processing after forming the silver halide grains. In order to obtain the silver halide emulsion satisfying aforesaid conditions, a heavy metal compound may be dissolved together with a halogenated salt and may be added continuously whole through entire grain formation process or at a part thereof.

The amount of the above-mentioned heavy metal ion when being added to the silver halide emulsion is preferably $1\times10^{-9}$ mol or more and $1\times10^{-2}$ mol or less, and specifically preferably $1\times10^{-8}$ mol or more and $5\times10^{-5}$ mol or less.

The preparation of the silver halide grains used for the present invention may be arbitrary. A preferable example of shape of the silver halide grain is cubic having a crystal surface of (100). In addition, by the use of methods described in references such as U.S. Pat. Nos. 4,183,756 and 4,225,666 and Japanese Patent O.P.I. Publication No. 55-26589, Japanese Patent Publication No. 55-42737 and The Journal of Photographic Science (J. Photogr. Sci) Nos. 21 and 39 (1973), grains having forms of octahedral, tetradecahedral and dodecahedral are formed to be used. In addition, grains having twinned plane may be used.

The silver halide grains used for the present invention may be grains of a single form.

There is no limit to grain size of the silver halide grains used for the present invention. However, if considering other photographic performances such as rapid processability and speed, 0.1–1.2 $\mu$m is preferable, and 0.2–1.0 $\mu$m is more preferable.

Aforesaid grain size can be measured using projected area or diameter approximate value of the grains. If the grains are substantially uniform, the grain size distribution can be represented considerably accurately in terms of diameter or projected area.

The silver halide grains used for the present invention is preferably a mono-dispersed silver halide grains in which variation coefficient of 0.22 or less and more preferably 0.15 or less.

It is specifically preferable to add two or more kind of mono-dispersed emulsion whose variation coefficient is 0.15 or less to an identical layer.

Here, variation coefficient is a coefficient representing the width of grain size distribution, and defined by the following equation:

$$\text{Variation coefficient}=S/R$$

wherein S represents a standard deviation of grain size distribution; and R represents an average grain size.

Here, "grain size" means a diameter of the silver halide grains when it is spherical. When the form of grain cubic or other than spherical, it means a diameter of a projected image when it is converted to a circle.

As a preparation device and method of the silver halide emulsion, various conventional ones known by those skilled in the art can be used.

The silver halide emulsion used for the present invention may be obtained any of an acid method, a neutral method and an ammonia method. Aforesaid grains may be grown at one step. They may be grown after forming seed grains. How to produce seed grains and how to grow grains may be the same or different.

As a method of reacting a soluble silver salt and a soluble halogenated substance salt, any methods including a normal precipitation method, a reverse precipitation method, a double jet method and their mixture may be used. It is preferable to use the double jet method. In addition, as one type of the double jet method, a pAg controlled double jet method described in Japanese Patent O.P.I. Publication No. 54-48521 may be used.

With regard to reacting device, a device disclosed in Japanese Patent O.P.I. Publication Nos. 57-92523 and 57-92524 wherein a water-soluble silver salt and an aqueous water-soluble halogenated substance salt solution are fed from an addition sub-device which is located in a reacting initial solution, a device disclosed in German Open Patent No. 2921164 wherein the density of a water-soluble silver salt and an aqueous water-soluble halogenated substance salt solution are continuously changed to be added and a device disclosed in Japanese Patent Publication No. 56-501776 wherein a reacting initial solution is taken up to outside of the reacting vessel and grains are formed while keeping distance between each silver halide grain by condensing grains by means of an ultrafiltration method may be used.

If necessary, a silver halide solvent such as thioether may be used. A compound having a mercapto group or a compound such as a nitrogen-containing compound or a sensitizing dye may be added during forming silver halide grains or after finish of forming the grains.

The silver halide emulsion may be subjected to a sensitization method using a gold compound and a sensitization method using a charcogen sensitizer in combination.

As a charcogen sensitizer applicable to the silver halide emulsion of the present invention, a sulfur sensitizer, a selenium sensitizer and a tellurium sensitizer may be used. Of these, a sulfur sensitizer is preferable.

As a sulfur sensitizer, a thiosulfate, an arylthiocarbamide thiourea, an arylisothiacyanate, cystine, p-toluenethiosulfonic acid salt, rhodanine and inorganic sulfur are cited.

The amount of the sulfur sensitizer may be changed depending upon the kind of silver halide emulsion applied and the scale of expected effects. It is preferably $5\times10^{-10}$–$5\times10^{-5}$ mol and more preferably $5\times10^{-8}$–$3\times10^{-5}$ mol per mol of silver halide.

A gold sensitizer may be added as each gold complex such as chloro aurate and gold sulfide. As a ligand compound used, dimethyl rhodanine, thiocyanate, mercapto tetrazole and mercapto triazole may be cited. The amount of gold compound is not uniform depending upon the kind of the silver halide emulsion, the kind of compound used and ripening conditions. It is preferably $1\times10^{-4}$–$1\times10^{-8}$ mol and more preferably $1\times10^{-5}$–$1\times10^{-8}$ mol per mol of silver halide.

As a chemical sensitization method of the silver halide emulsion, a reduction sensitization method may be used.

To the silver halide emulsion, in order to prevent fogging which occurs during preparation process of the silver halide photographic light-sensitive material, to minimize performance fluctuation during storage and to prevent fogging which occurs when a light-sensitive material is developed, a conventional anti-foggant and a stabilizer. As an example of a preferable compound usable for aforesaid purposes, compounds represented by Formula (II) described in Japanese Patent O.P.I. Publication No. 2-146036, on page 7, at-the lower column can be cited. As more preferable compounds, compounds (IIa-1) through (IIa-8) and (IIb-1) through (IIb-7) described in aforesaid invention, on page 8 and compounds such as 1-(3-methoxyphenyl)-5-mercaptotetrazole and 1-(4-ethoxyphenyl)-5-mercapto tetrazole are cited. Depending on their purposes, the above-mentioned compounds may be added in a preparation process, a chemical sensitization process, after aforesaid chemical sensitization process and a coating composition preparation process. When chemical sensitization is conducted in the presence of aforesaid compounds, the amount used is preferably $1\times10^{-5}$–$5\times10^{-4}$ mol per mol of silver halide. When adding them after finish of the chemical sensitization, the amount added is preferably $1\times10^{-6}$–$1\times10^{-2}$ mol and more preferably $1\times10^{-5}$–$5\times10^{-3}$ mol per mol of silver halide. When adding there to the silver halide emulsion layer in the coating composition preparation process, the amount added is preferably $1\times10^{-6}$–$1\times10^{-1}$ mol and more preferably $1\times10^{-5}$–$1\times10^{-2}$ mol per mol of silver halide. When they are added to layers other than the silver halide emulsion layer, the amount of them in the coating layer is preferably $1\times10^{-9}$–$1\times10^{-3}$ mol per 1 $m^2$.

As for the silver halide emulsion, a surface latent image forming silver halide emulsion that forms a negative image by conducting development, may be used. In addition, a positive image may be directly formed by conducting surface development providing fogging treatment after image exposure by using an inner latent image forming silver halide emulsion whose surface is not fogged previously. The inner latent image forming silver halide emulsion is an emulsion comprising silver halide grains that has light sensitive nuclei mainly at inner part of the grain to form a latent image inner part of the grain by exposure.

To the silver halide photographic light-sensitive material used for the present invention, a dye which has absorption on various wavelength region for the purposes of anti-irradiation and anti-halation. For the purposes, any of compounds can be used. As a dye having absorption on a visible region, dyes AI-1 through 11 described in Japanese Patent O.P.I. Publication 3-251840, on page 308 and dyes described in Japanese Patent O.P.I. Publication No. 6-3770 are preferably used. As an infrared absorption dye, compounds represented by Formulas (I), (II) and (III) described in Japanese Patent O.P.I. Publication No. 1-280750, on page 2, at lower left column have preferable spectral properties. They provide no adverse influence on the photographic properties of the silver halide photographic emulsion and also provide no contamination due to color residue. As practical examples preferred, illustrated compounds (1) through (45) illustrate in aforesaid specification, from page 3, lower left column to 5 page lower left column.

With regard to an amount in which aforesaid dyes are added, if the purpose of to improve sharpness, an amount which causes the spectral reflective density of unprocessed sample at 680 nm is 0.7 or more is preferable, and 0.8 or more is specifically preferable.

When a silver halide photographic light-sensitive material is used as a color photographic light-sensitive material, it is combined with a yellow coupler, a magenta coupler and a cyan coupler to have layers containing a silver halide emulsion subjected to spectral sensitization on a specific region of 400–900 nm. Aforesaid silver halide emulsion contains one kind of or two or more kind of sensitizing dyes in combination.

As a spectral sensitizing dye used in the silver halide emulsion, any of compounds can be used. As a blue sensitive sensitizing dye, compounds BS-1 through 8 described in Japanese Patent O.P.I. Publication No. 3-251840 can be preferably used independently or mixingly in combination. As a green sensitive sensitizing dye, GS-1 through 5 described in Japanese Patent O.P.I. Publication No. 3-251840, on page 28 are preferably used. It is preferable to mix aforesaid infrared, red, green and blue sensitive sensitizing dyes with super sensitizers SS-1 through SS-9 described in Japanese Patent O.P.I. Publication No. 4-285950, on pp. 8–9 or compounds S-1 through S-17 described in Japanese Patent O.P.I. Publication No. 5-66515, on pp. 15–17.

Addition timing of aforesaid sensitizing dye may be arbitrary from formation of the silver halide grains to complete of chemical sensitization.

As an addition method of the sensitizing dye, they may be dissolved in water-mixing organic solvent such as methanol, ethanol, alcohol fluoride, acetone and dimethylformamide or water, and added as a solution. Or, they may be added as a solid dispersant.

The present invention is suitably adopted to the silver halide light sensitive material having infrared sensitivity. For obtaning infrared sensitivity infrared sensitizing dye can be used.

Infrared sensitizing dyes may be employed. As for the infrared dyes, tricarbocyanine and/or 4-quinoline nucleus containing dicarbocyanine dyes are preferred, and of these, tricarbocyanine dyes are particularly preferred.

Of tricarbocyanines, those which are particularly useful are represented by the following general formula (Ia) or (Ib).

General formula (Ia)

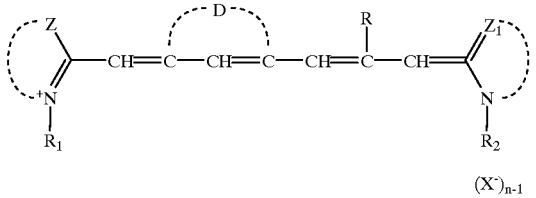

General formula (Ib)

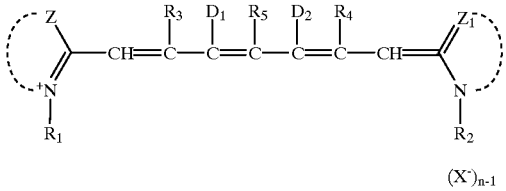

In the general formulas (Ia) and (Ib), $R_1$ and $R_2$ are the same or different and each represents an alkyl group (preferably an alkyl group having from 1 to 8 carbon atoms, for example, a methyl group, an ethyl group, a propyl group, a butyl group, a pentyl group, a heptyl group, etc.), a substituted alkyl group, (as the substituent, for example, a carboxy group, a sulfo group, a cyano group, a halogen atom (for example, a fluorine atom. a chlorine atom, a bromine atom, etc.), a hydroxy group, an alkoxycarbonyl group (preferably, an alkoxycarbonyl group having carbon atoms of not more than 8, for example, a methoxycarbonyl group, an ethoxycarbonyl group, a benzyloxycarbonyl group, etc.), an alkoxy group (preferably, an alkoxy group having carbon atoms of not more than 7, for example, a methoxy group, an ethoxy group, a propoxy group, a butoxy group, a benzyloxy group, etc.), an acyloxy group (preferably, an acyloxy group having carbon atoms of not more than 3, for example, an acetyloxy group, etc.), an acyl group (preferably, an acyl group having carbon atoms of not more than 8, for example, an acetyl group, a propionyl group, an benzoyl group, a mesyl group, etc.), a carbamoyl group (for example, a carbamoyl group, an N,N-dimethylcarbamoyl group, a morpholinocarbamoyl group, a piperidinocarbamoyl group, etc.), a sulfamoyl group (for example, a sulfamoyl group, an N,N-dimethylsulfamoyl group, a morpholinosulfonyl group, etc.), an alkyl group (the number of carbon atoms in the alkyl part is not more than 6) substituted with an aryl group (for example, a phenyl group, a p-hydroxyphenyl group, a p-carboxyphenyl group, a p-sulfophenyl group, an α-naphthyl group, etc.), however, these substituents may be substituted to an alkyl group of not less than 2)).

R represents a hydrogen atom, a methyl group, a methoxy group, and an ethoxy group.

$R_3$ and $R_4$ each represents a hydrogen atom, an alkyl group (for example, a methyl group, an ethyl group, a propyl group, etc.), a phenyl group, and a benzyl group.

$R_5$ represents a hydrogen atom, an alkyl group (for example, a methyl group, an ethyl group, a propyl group, etc.), an alkoxy group (for example, a methoxy group, an ethoxy group, a propoxy group, a butoxy group, etc.), a phenyl group, and a benzyl group.

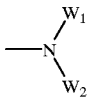

wherein $W_1$ and $W_2$ each represents a substituted or unsubstituted alkyl group (the number of carbon atoms of the alkyl part is between 1 and 18, and preferably between 1 and 4, for example, a methyl group, an ethyl group, a propyl group, a butyl group, a naphthyl group, a tolyl group, a p-chlorophenyl group, etc.). Furthermore, $W_1$ and $W_2$ may link with each other to form a nitrogen-containing 5-membered or 6-membered heterocyclic ring.

D represents a group of atoms to form a divalent alkylene bond, for example an ethylene or trimethylene, and the alkylene bond may be substituted with one or more of suitable groups, for example, an alkyl group having from 1 to 4 carbon atoms (for example, a methyl group, an ethyl group, a propyl group, an isopropyl group, a butyl group, etc.), a halogen atom (for example, a chlorine atom, a bromine atom, etc.), an alkoxy group (an alkoxy group having from 1 to 4 carbon atoms, for example, a methoxy group, an ethoxy group, a propoxy group, an isopropoxy group, a butoxy group, etc.).

$D_1$ and $D_2$ each represents a hydrogen atom. Furthermore, $D_1$ and $D_2$ may link with each other to form a divalent alkylene bond which is the same as the above-mentioned D.

Z and $Z_1$ each represents a group of nonmetallic atoms necessary for forming a nitrogen-containing 5-membered or 6-membered heterocyclic ring. The nitrogen-containing 5-membered or 6-membered heterocyclic ring formed by Z or $Z_1$ may comprise a condensed ring. The nitrogen-containing 5-memberd or 6-membered heterocyclic rings, which may comprise a condensed ring, include, for example, a thiazole nucleus (for example, benzthiazole, 4-chlorobenzthiazole, 5-chlorobenzthiazole, 6-chlorobenzthiazole, 7-chlorobenzthiazole, 4-methylbenzthiazole, 5-methylbenzthiazole, 6-methylbenzthiazole, 5-bromobenzthiazole, 6-bromobenzthiazole, 5-iodobenzthiazole, 5-phenylbenzthiazole, 5-methoxybenzthiazole, 6-methoxybenzthiazole, 5-ethoxybenzthiazole, 5-carboxybenzthiazole, 5-ethoxycarbonylbenzthiazole, 5-phenetylbenzthiazole, 5-fluorobenzthiazole, 5-trifluoromethylbenzthiazole, 5,6-dimethylbenzthaizole, 5-hydroxy-6-methylbenzthiazole, tetrahydro-5-benzthiazole, 4-phenylbenzthiazole, naphtho[2,1-d]thiazole, naphtho[1,2-d]thiazole, naphtho[2,3-d]thiazole, 5-methoxynaphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.); a selenazole nucleus (for example, benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), an oxazole nucleus (benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 4,6-dimethylbenzoxazole, 5-ethoxybenzoxazole, naphtho[2,1-d]oxazole, naphtho[1,2-d]oxazole, naphtho[2,3-d]oxazole, etc.), a quinoline nucleus (for example, 2-quinoline, 3-methyl-2-quinolin, 5-ethyl-2-quinoline, 6-methyl-2-quinoline, 8-fluoro-2-quinoline, 6-methoxy-2-quinoline, 6-hydoxy-2-quinoline, 8-chloro-2-quinoline, 8-fluoro-4-quinoline, etc.), a 3,3 -dialkylindolenine nucleus (for example, 3,3-dimethylindolenine, 3,3-dimethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.), an imidazole nucleus (for example, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-alkyl-5-methoxybenzimidazole, 1-methyl-5-cyanobenzimidazole, 1-ethyl-5-cyanobenzimidazole, 1-methyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole, etc.), a pyridine nucleus (for example, pyridine, 5-methyl-2-pyridine, 3-methyl-4-pyridine, etc.). Of these, preferably, the thiazole nucleus and oxathiazole nucleus are advantageously employed. More preferably, the benzthiazole nucleus, naphthothiazole nucleus, naphthoxazole nucleus, or benzoxazole nucleus can be advantageously employed.

$X^-$ represents an acid anion.

n is 1 or 2.

Among 4-quinoline nucleus containing dicarbocyanine dyes, those which are particularly useful are represented by general formula (II) mentioned below.

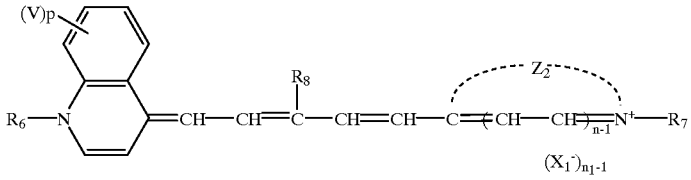

wherein $R_6$ and $R_7$ are the same as the above-mentioned $R_1$ and $R_2$.

$R_8$ is the same as the above-mentioned $R_3$. However, $R_8$ is preferably an alkyl group or a benzyl group.

V represents a hydrogen atom, an alkyl group (for example, a methyl group, an ethyl group, a propyl group, etc.), an alkoxy group (for example, a methoxy group, an ethoxy group, a butoxy group, etc.), a halogen atom (for example, a fluorine atom, chlorine atom, etc.), a substituted alkyl group (for example, a trifluoromethyl group, a carboxymethyl group, etc.).

$Z_2$ is the same as the above-mentioned Z and $Z_1$.

$X_1$ is the same as the above-mentioned X.

n, $n_1$, and p each represents 1 or 2.

Specific examples of sensitizing dyes employed in the present invention are shown below.

1-1

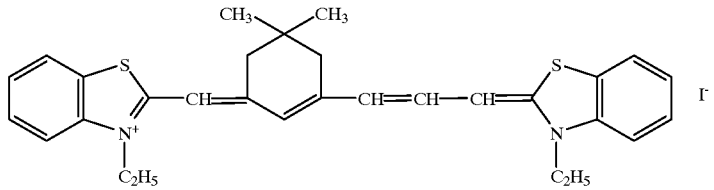

1-2

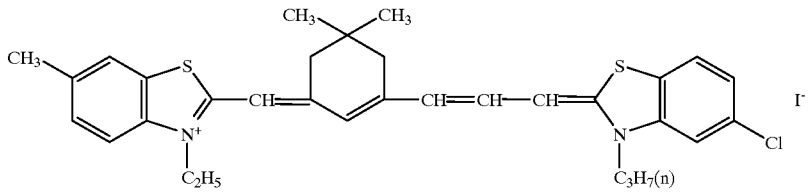

1-3

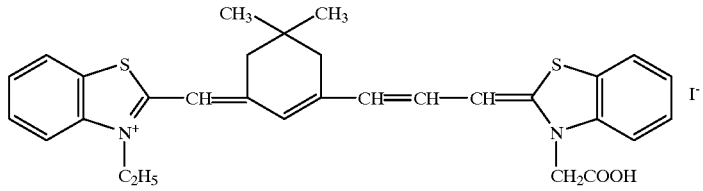

1-4

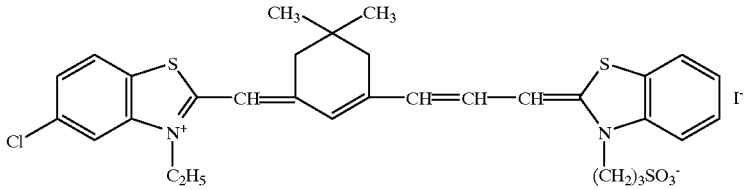

1-5

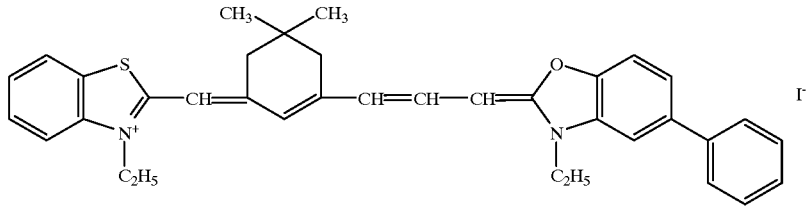

1-6

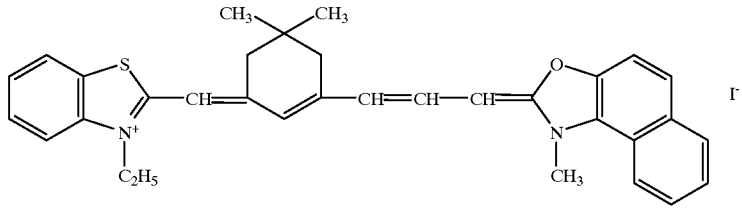

-continued
1-7
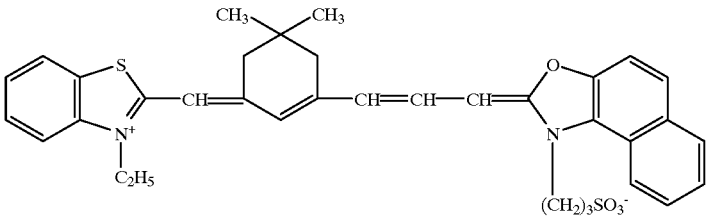
1-8
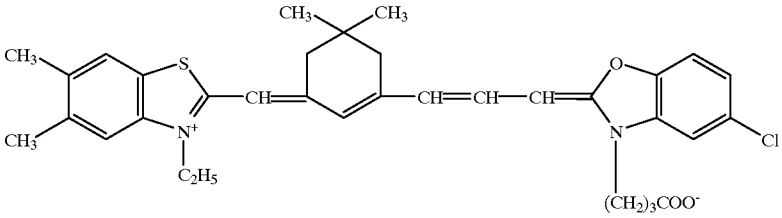
1-9
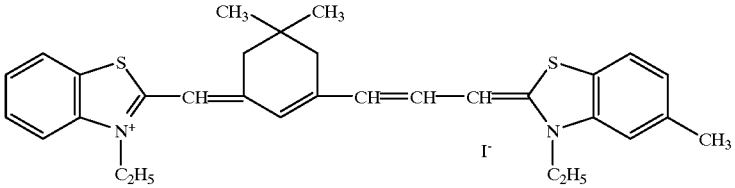
1-10
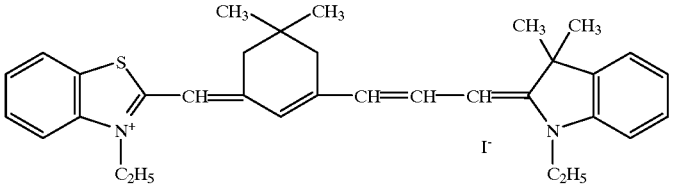
1-11
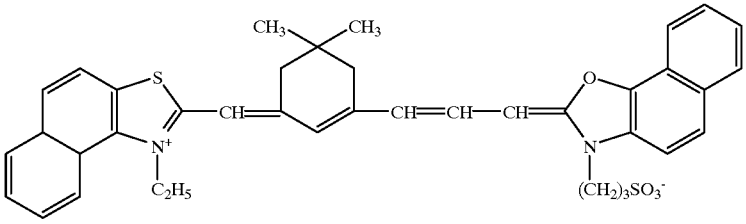
1-12
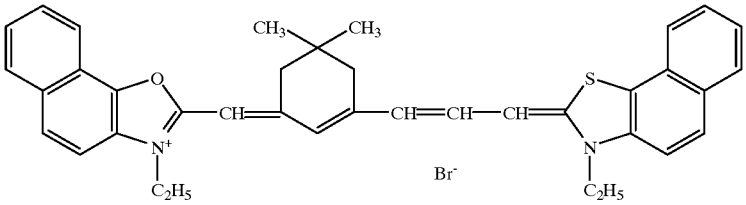
1-13
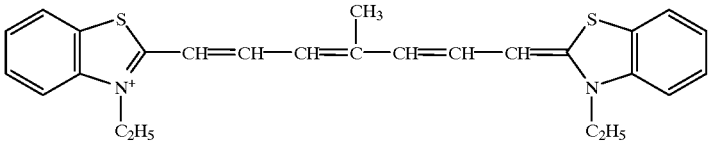

-continued
1-14
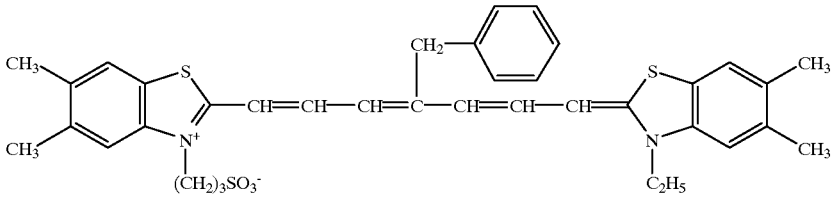
1-15
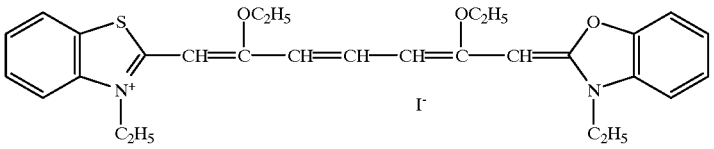
1-16
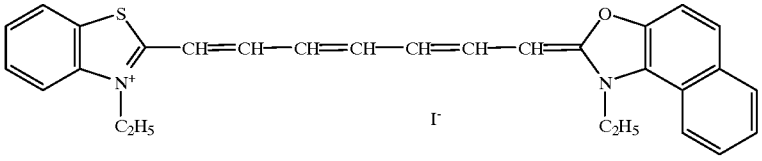
1-17
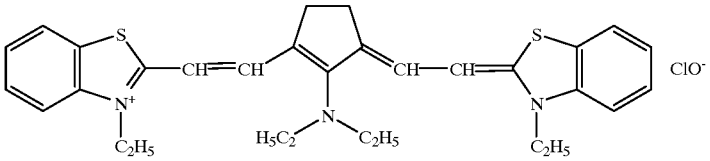
1-18
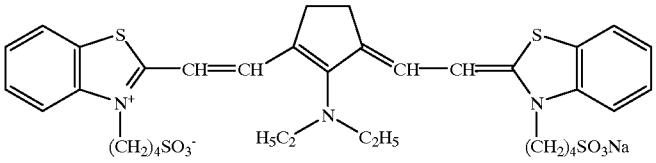
1-19
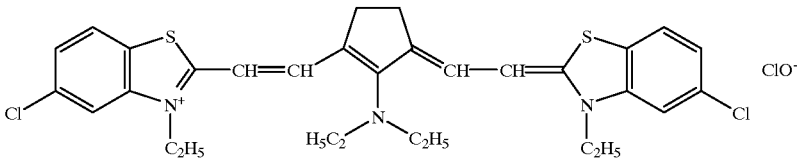
1-20
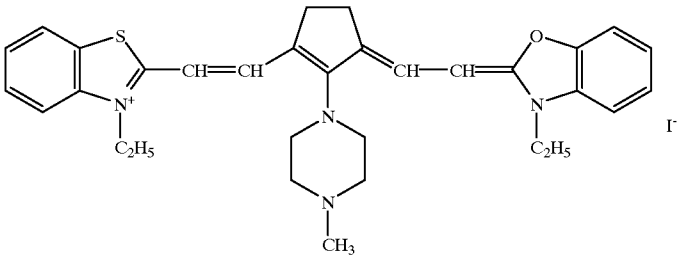
1-21
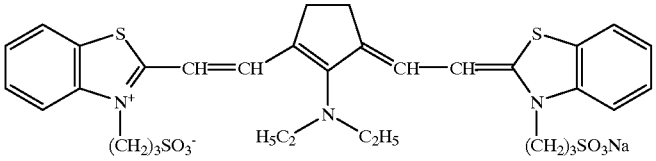

-continued
1-22
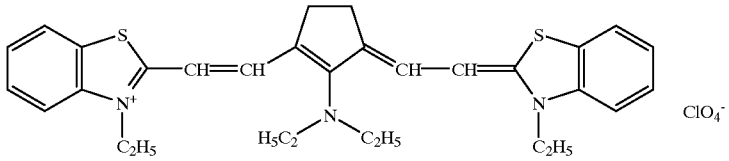
II-1
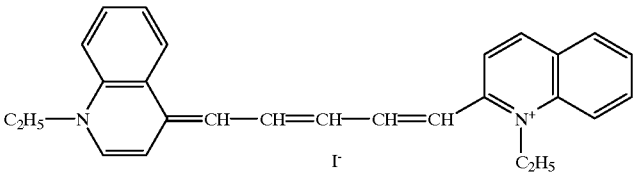
II-2
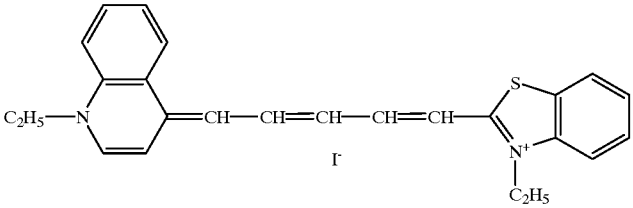
II-3
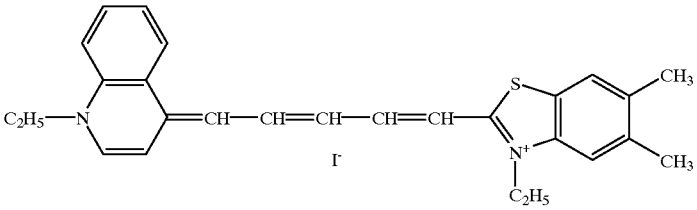
II-4
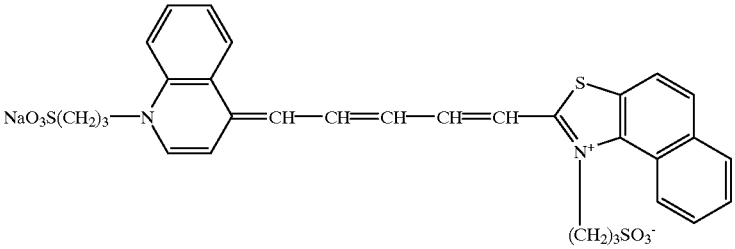
II-5
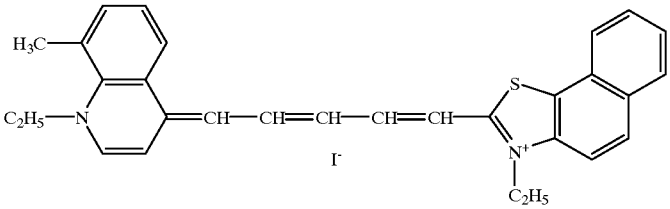
II-6
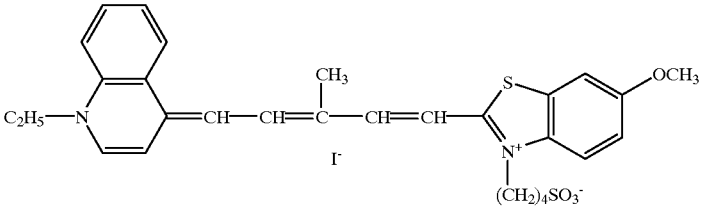

-continued
II-7
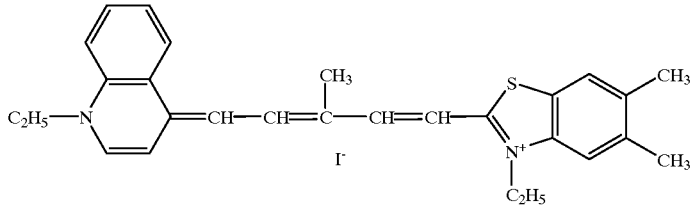
II-8
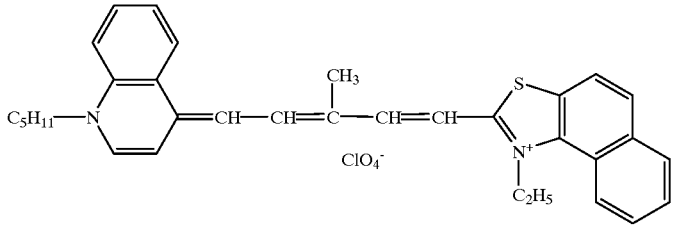
II-9
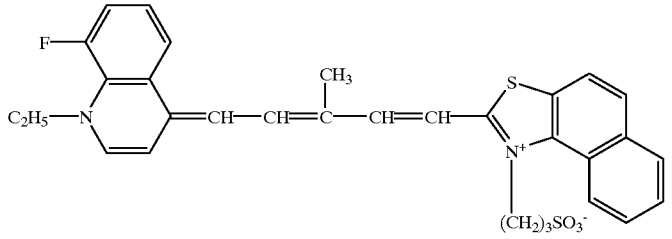
II-10
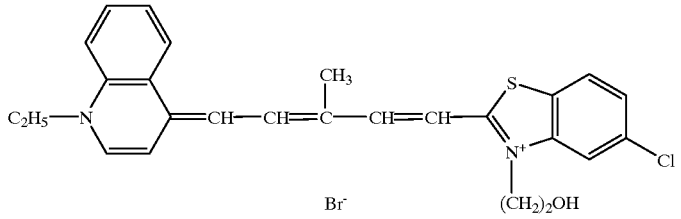
II-11
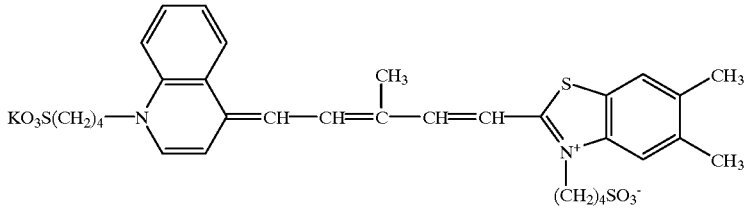
II-12
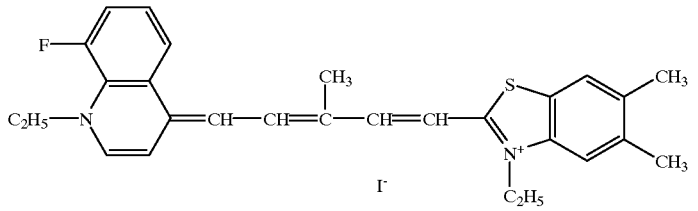

-continued
II-13
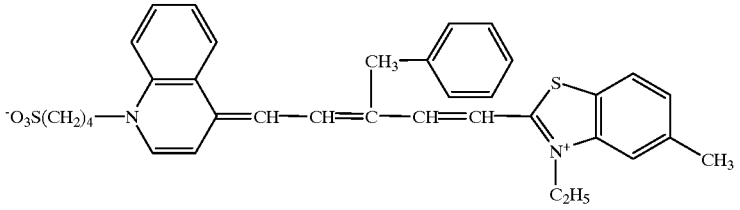
II-14
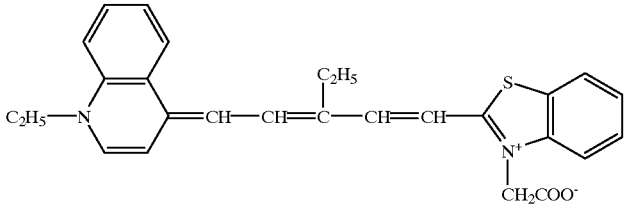
II-15
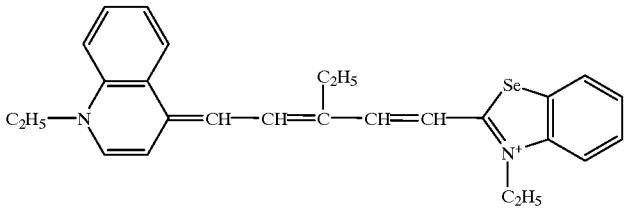
II-16
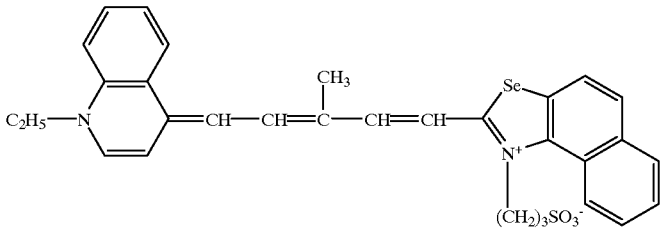
II-17
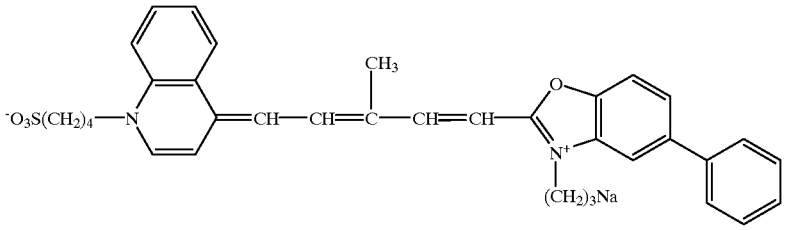
II-18
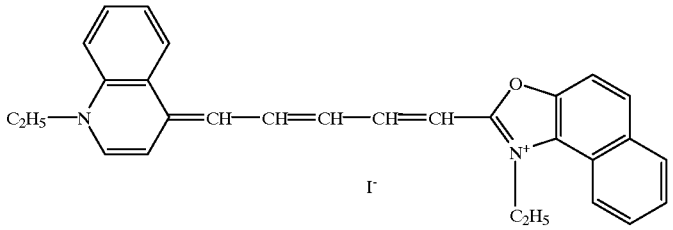

-continued

II-19

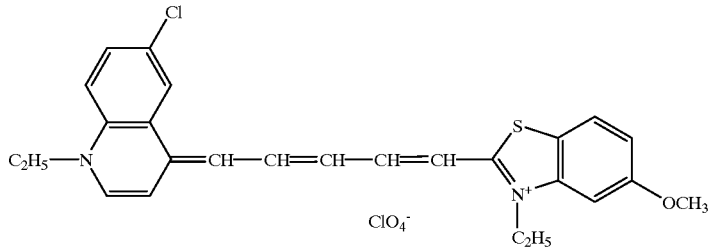

II-20

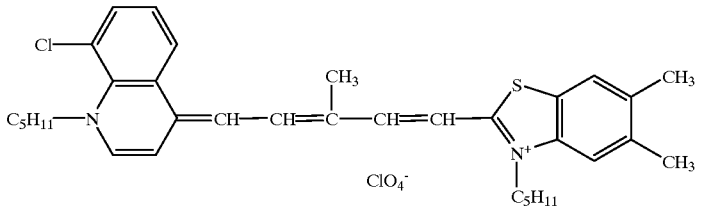

II-21

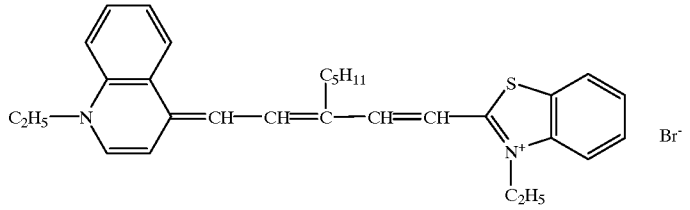

The added amount of an infrared sensitizing dye to a silver halide photographic emulsion is between $5\times10^{-7}$ and $1\times10^{-2}$ mole per mole of silver halide; preferably between $2\times10^{-6}$ and $4\times10^{-3}$ mole, and most preferably between $5\times10^{-6}$ and $2\times10^{-3}$ mole.

An infrared sensitizing dye can be directly dispersed into an emulsion. Furthermore, the dye is first dissolved in a suitable solvent such as, for example, methyl alcohol, ethyl alcohol, methyl cellosolve, acetone, water, pyridine or mixtures thereof and the resulting solution can be added to an emulsion. The dye is generally added after chemical ripening. However, it may be added during grain formation or prior to chemical sensitization. Furthermore, an ultrasonic wave can be employed to dissolve a dye. In order to incorporate a dye into an emulsion, methods are employed which are described in U.S. Pat. Nos. 2,912,343, 3,342,605, 2,996,287, 3,429,835, etc. Furthermore, before an infrared'sensitizing dye represented by the general formulas (Ia), (Ib) and (II) is coated onto a suitable support, it may be uniformly dispersed into an emulsion. However, as mentioned above, it may be dispersed in any process during emulsion preparation.

Supersensitization can be practised which is performed by combination of an infrared sensitizing dye with other sensitizing dye. Sensitizing dyes can be employed together, which are described, for example, in U.S. Pat. Nos. 3,703,377, 2,688,545, 3,397,060, 3,615,635, and 3,628,964; U.K. Patent Nos. 1,242,588 and 1,293,862; Japanese Patent Publication Nos. 43-4936, 44-14030, and 43-0773; U.S. Pat. No. 3,416,927; Japanese Patent Publication No. 43-4930; U.S. Pat. Nos. 3,615,613, 3,615,632, 3,617,295, and 3,635,721, etc.

As a coupler any compounds forming coupling product having maximum absorption wave length of 340 nm or more upon reaction with oxidation product of color developing agent are employed. Typically representative compounds are those known as a yellow dye forming coupler having a spectral absorption maximum wavelength on wavelength range of 350–500 nm, those known as a magenta dye forming coupler having a spectral absorption maximum wavelength on wavelength range of 500–600 nm and those known as a cyan dye forming coupler having a spectral absorption maximum wavelength on wavelength region of 600–750 nm.

As a cyan coupler preferably used for the silver halide photographic light-sensitive material of the present invention, couplers represented by Formulas (C-I) and (C-II) described in Japanese Patent O.P.I. Publication No. 4-114154, on page 5 at lower left column. Practical compounds include CC-1 through CC-9 described in aforesaid specification, from page 5 lower right column to page 6 lower left column.

As a magenta coupler preferably used for the silver halide photographic light-sensitive material of the present invention, couplers represented by Formulas (M-I) and (M-II) described in Japanese Patent O.P.I. Publication No. 4-114154. Practically, MC-1 to MC-11 described in aforesaid specification on page 4, lower left column to page 5 upper right column are cited. Of the above-mentioned magenta couplers, the more preferable ones are couplers represented by Formula (M-I) in aforesaid specification, on page 4, upper right column. Further of these, couplers in which RM of the above-mentioned Formula (M-I) is a tertiary alkyl group is specifically preferable since they are excellent in terms of light fastness. MC-8 through MC-11 described in aforesaid specification, page 5, upper column are excellent in terms of color reproducibility from blue to violet and red, and also excellent in terms of detailed drawing ability.

As a yellow coupler preferably used for the silver halide photographic light-sensitive material of the present invention, couplers represented by Formulas Y-I described in Japanese Patent O.P.I. Publication No. 4-114154. Practically, YC-1 to YC-9 described in aforesaid specification on page 3, lower left column and thereafter are cited. Of the above-mentioned magenta couplers, the more preferable ones are couplers represented by formula Y-1 having alkoxy group as $R_{Y1}$, and couplers represented by formula I of Japanese Patent O.P.I. Publication No. 6-67388 in view of reproduction of preferable yellow tone. Further of these, couplers YC-8 and YC-9 described in Japanese Patent O.P.I. Publication No. 4-114154, page 4, upper left column and Couplers No 1 to 47 described in Japanese Patent O.P.I. Publication No. 6-67388 are cited as an excellent examples. The most preferable compounds are those represented by formula Y-1 described in pages 1 and 11 to 17 of Japanese Patent O.P.I. Publication No. 4-81847.

In case that the a method of dispersion of oil in water emulsifying process of adding organic compounds such as the coupler, the organic compounds are dissolved in a water insoluble organic solvent having high boiling point, usually not more than 150° C., using, if necessary, low boiling point and/or water soluble organic solvent, and then, dispersed in hydrophilic binder such as gelatin solution with the aid of surfactant. A mixer, a homogenizer, a colloid mill, a flow jet mixer, a ultra sonic dispersion apparatus or so may be used as a dispersion means. A process of removing low boiling point organic solvent may be applied during or after the dispersion process.

The preferable example of the high boiling point organic solvent dissolving the coupler used for the dispersing includes phthalic acid ester compounds such as dioctyl phthalate, di-i-decyl phthalate and dibutyl phthalate, phosphoric acid ester compounds such as tricresyl phosphate or trioctyl phosphate. Dielectric constant of the high boiling point organic solvent is preferably 3.5 to 7.0. Two or more high boiling point organic solvents may be used in combination.

A polymer compound insoluble in water and soluble in organic solvent may be used dispersing the organic compound in place of, or using in combination with the high boiling point organic solvent. The polymer compound is dispersed with the organic compound in hydrophilic binder such as gelatin solution with the aid of surfactant. An example of the polymer includes poly(N-t-butylacrylamide).

As a preferable surfactant used for regulating surface tension when photographic additives are dispersed or coated, hydrophobic group having 8 to 30 carbons in one molecule and a sulfonic acid group and their salt. Practically, A-1-A-11 described in Japanese Patent O.P.I. Publication No. 64-26854 are cited. In addition, surfactants in which a fluorine atom is substituted with an alkyl group are also preferably used. Aforesaid dispersed composition are ordinarily added to a coating composition containing a silver halide emulsion. Time until they are added to the coating composition after being dispersed and time from they are added to the coating composition to coating are the shorter the better. They are respectively within 10 hours. Within 3 hours and within 20 minutes are more preferable.

It is preferable to use an anti-color fading agent in combination with each of the above-mentioned couplers in order to prevent color fading of dye image due to light, heat and humidity. As a preferable compound for a magenta dye use, phenyl-ether-containing compounds represented by Formulas I and II described in Japanese Patent O.P.I. Publication No. 2-66541, on page 3, phenol-containing compounds represented by Formula IIIB described in Japanese Patent O.P.I. Publication No. 3-174150, amine-containing compounds represented by Formula A in Japanese Patent O.P.I. Publication No. 64-90445 and metal complex represented by Formula XII, XIII, XIV and XV described in Japanese Patent O.P.I. Publication 5-182741 are preferable. As preferable compounds for a yellow dye and a cyan dye, compounds represented by I' described in Japanese Patent O.P.I. Publication No. 1-196049, and compounds represented by Formula II described in Japanese Patent O.P.I. Publication No. 5-11417 are preferable.

In order to shift absorption wavelength of a coloring dye, a compound (d-11) described in Japanese Patent O.P.I. Publication No. 4-114154, page 9, on lower left column and compound (A'-1) described in aforesaid specification, on page 10, on a lower left column can be used. Other than above, fluorescent dye releasing compounds described in U.S. Pat. No. 4,774,187 can be used.

With regard to the silver halide light-sensitive material, it is preferable to minimize color stain by adding a compound which reacts with a developing agent oxidized product and adding between a light-sensitive layer and another light-sensitive layer. As a compound used for aforesaid purpose, hydroquinone derivatives are preferable. More preferably, dialkyl hydroquinone such as 2,5-di-t-octyl hydroquinone is preferable. More specifically, compounds represented by Formula II described in Japanese Patent O.P.I. Publication No. 4-133056 are cited, and compounds II-1 through II-14 described in aforesaid specification, pp. 13–14 and compound 1 described on page 17 are cited.

It is also preferable to add a UV absorber to the light-sensitive material, in order to minimize static fogging and improve light-fastness of a dye image. Preferable UV ray absorbers include benzotriazoles. The specifically preferable compounds include compounds represented by Formula III-3 in Japanese Patent O.P.I. Publication No. 1-250944, compounds represented by Formula III described in Japanese Patent O.P.I. Publication No. 64-66646, UV-1L -UV-27L described in Japanese Patent O.P.I. Publication No. 63-187240, compounds represented by Formula I described in Japanese Patent O.P.I. Publication No. 4-1633 and compounds represented by Formulas (I) and (II) described in Japanese Patent O.P.I. Publication No. 5-165144 are cited.

It is advantageous to use gelatin as a binder in the silver halide photographic light-sensitive material. As necessary, other gelatins, gelatin derivatives, graft polymer between gelatin and another polymer, protein other than gelatin, sugar derivatives, cellulose derivatives and hydrophilic colloid such as synthetic hydrophilic polymer such as a monomer or a copolymer may be used.

Gelatin used in the silver halide photographic light-sensitive material of the invention may be lime processed gelatin, acid processed gelatin or gelatin made from ox bone, ox hide, pig hide etc. preferably lime gelatin made from ox bone or pig hide.

For hardening the these binder vinylsulfon hardener, chlorotriazine hardener, polymer hardener or carboxyl group activate hardener are used solely or in combination. Preferable examples are compounds described in Japanese Patent O.P.I. Publication Nos. 61-249054 and 61-245153.

In order to prevent propagation of mildews and bacteria which adversely influence photographic performance and image storage stability, it is preferable to incorporate anti-mildew agent and an antiseptics as described in Japanese Patent O.P.I. Publication No. 3-157646. In order to improve the surface property of the silver halide light sensitive material or processed sample, it is preferable to add a lubricant described in Japanese Patent O.P.I. Publication Nos. 6-118543 and 2-73250 in the protective layer.

When coating a photographic light-sensitive material employing a silver halide emulsion, a thickening agent may be used for improving coating properties. As a coating method, an extrusion coating method and a curtain coating method are specifically useful which can coat two or more kind of layers concurrently.

In order to form a photographic image using the silver halide photographic light-sensitive material, an image recorded on the negative film may be optically image-formed on the silver halide photographic light-sensitive material to be printed. Aforesaid image may be temporarily converted to digital information and the resulting image may be image-formed on a CRT (cathode ray tube), and then, aforesaid image may be image-formed on the silver halide photographic light-sensitive material to be printed. Or, an image may be printed by scanning while the strength of the laser beam is changed based on digital information.

The light-sensitive material does not preferably contain a developing agent in the light-sensitive material is applied to a light-sensitive material forming an image for direct appreciation specifically. For example, it is applicable to color paper, color reversal paper, light-sensitive materials forming a positive image, light-sensitive materials for display use and light-sensitive materials for color proof use. Specifically, it is preferable to apply to light-sensitive materials having a reflective support.

In case that the silver halide light sensitive photographic material is a silver halide light sensitive color photographic material, it is processed by color development after exposure.

As an aromatic primary amine developing agent used for the color development of the silver halide light sensitive color photographic material, conventional compounds may be used. As examples of aforesaid compounds, the following compounds may be illustrated:

CD-1) N,N-diethyl-p-phenylenediamine

CD-2) 2-amino-5-diethylamino toluene

CD-3) 2-amino-5-(N-ethyl-N-)laurylamino)toluene

CD-4) 4-(N-ethyl-N-(β-hydroxyethyl)amino)aniline

CD-5) 2-methyl-4-(N-ethyl-N-(β-hydroxyethyl)amino) aniline

CD-6) 4-amino-3-methyl-N-ethyl-N-(β-(methansulfonamide) ethyl) aniline

CD-7) N-(2-amino-5-diethylaminophenylethyl) methanesulfonamide

CD-8) N,N-dimethyl-p-phenylenediamine

CD-9) 4-amino-3-methyl-N-ethyl-N-methoxyethylaniline

CD-10) 4-amino-3-methyl-N-ethyl-N-(β-ethoxyethyl) aniline

CD-11) 4-amino-3-methyl-N-ethyl-N-(γ-hydroxypropyl) aniline

The above-mentioned color developing composition may be used at an arbitrary pH region. However, from viewpoint of rapid processability, it is preferable that pH is 9.5 to 13.0, and it is more preferable that pH is 9.8 to 12.0.

The processing temperature of color developing of the present invention is 35° C. or more and 70° C. or less. The higher the temperature is, the shorter the processing time is. However, if the temperature is not too high, stability of the processing composition is acceptable. It is preferable to process at 37° C. or higher and 60° C. or lower.

Time for color developing is conventionally 3 minutes and 30 seconds. Less than 40 seconds is preferable, and within 25 seconds is more preferable.

To a color developing composition, conventional developing composition component compounds may be added in addition to the above-mentioned color developing agent. Ordinarily, development inhibitors such as an alkaline agent having pH buffer effect, chlorine ion and benzotriazole, preserver and a chelating agent are used.

The silver halide photographic light-sensitive material of the present invention may be subjected to bleaching process and fixing process after color developing. The bleaching process may be conducted concurrently with the fixing process. After fixing process, it is ordinary that washing process is applied. In place of the washing process, stabilizing process may be applied.

As a developing apparatus used for developing the silver halide photographic light-sensitive material of the present invention, a roller transportation type in which a light-sensitive material is sandwiched by rollers provided in the processing tank to be conveyed or an endless belt type in which the light-sensitive material is fixed on a belt. In addition, a system in which the processing tank is formed in a slip shaped and the light-sensitive material is conveyed together with feeding the processing composition onto aforesaid processing tank, a spray type in which a processing composition is sprayed, a web type in which a carrier immersed in the processing composition is contacted and a type using a viscosity processing composition. When a light-sensitive material is processed in a large amount, it is ordinary to conduct running processing using an automatic developing machine. In this occasion, the replenishment amount of the replenisher composition is smaller, the preferable. The most preferable processing style from viewpoint of environment friendliness is to add a replenishing composition in a form of replenishing tablet. A method disclosed in Published Technical Report No. 16935/1994 is the most preferable.

When the invention is applied to a color proof light sensitive material, a light source scanning exposure type automatic process is preferable to form an image. Practical examples of apparatus or system for forming image includes Konsensus L, Konsensus 570 and Konsensus II, all of product of Konica Corporation.

EXAMPLE

The present invention will be explained referring to examples.

Example 1

On both sides of paper pulp whose weight was 180 g/m$^2$, high density polyethylene was laminated so that a paper support was prepared. On a side in which an emulsion layer was coated, molten polyethylene containing anatase type titanium oxide in which its surface has been processed was dispersed in the content of 13 wt % so that a reflective support was prepared. This reflective support was subjected to corona discharge, and then a gelatin subbing layer was prepared.

The coating composition was prepared in the following manner.

Coating composition for the second layer

To 23.4 g of a yellow coupler (Y-1), 3.34 g of dye image stabilizer (ST-1), 3.34 g of (ST-2), 3.34 g of (ST-5), 0.34 g of anti-stain agent (HQ-1), 5.0 g of image stabilizer A, 5.0 g of a high boiling organic solvent (DBP) and 1.67 go of a high boiling organic solvent (DNP), 60 ml of ethyl acetate was added to be dissolved. Using a ultrasonic homogenizer, the above-mentioned composition was emulsified and dispersed in a 220 ml of 10% aqueous gelatin solution containing 7 ml of a 20% surfactant (SU-1) so that a yellow coupler dispersed composition was prepared. This dispersed composition was mixed with a blue sensitive silver halide emulsion prepared under the following conditions so that a coating composition for the second layer was prepared.

The first, 3rd through 8th layer

The coating compositions for the first and 3rd layer through 8th layer were also prepared in the same manner as in the coating composition for the first layer having an amount as shown in Tables 1 and 2.

Hardener H-1 and H-2 were added. As a coating aid, surfactants (SU-2) and (SU-3) were added for regulating surface tension.

TABLE 1

| Layer | Composition | Amount ($g/m^2$) |
|---|---|---|
| 8th layer (Protective layer) | Gelatin | 1.00 |
| | DBP | 0.002 |
| | DIDP | 0.002 |
| | Silicon dioxide | 0.003 |
| 7th layer (UV ray absorption layer) | Gelatin | 0.40 |
| | AI-1 | 0.01 |
| | UV absorber (UV-1) | 0.12 |
| | UV absorber (UV-2) | 0.04 |
| | UV absorber (UV-3) | 0.16 |
| | Anti-stain agent (HQ-5) | 0.04 |
| | PVP | 0.03 |
| 6th layer (Red sensitive layer) | Gelatin | 1.30 |
| | Red sensitive silver bromochloride emulsion (Em-R) | 0.21 |
| | Cyan coupler (C-1) | 0.25 |
| | Cyan coupler (C-2) | 0.08 |
| | Dye image stabilizer (ST-1) | 0.10 |
| | Anti-stain agent (HQ-1) | 0.004 |
| | DBP | 0.10 |
| | DOP | 0.20 |
| 5th layer (UV ray absorption layer) | Gelatin | 0.94 |
| | UV absorber (UV-1) | 0.28 |
| | UV absorber (UV-2) | 0.09 |
| | UV absorber (UV-3) | 0.38 |
| | AI-1 | 0.02 |
| | Anti-stain agent (HQ-5) | 0.10 |

TABLE 2

| Layer | Composition | Amount ($g/m^2$) |
|---|---|---|
| 4th layer (Green sensitive layer) | Gelatin | 1.30 |
| | AI-2 | 0.01 |
| | Green sensitive silver bromochloride emulsion (Em-G) | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |

TABLE 2-continued

| Layer | Composition | Amount ($g/m^2$) |
|---|---|---|
| | DBP | 0.13 |
| 3rd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.04 |
| | DBP | 0.02 |
| 2nd layer (Blue sensitive layer) | Gelatin | 1.20 |
| | Blue sensitive silver bromochloride emulsion (Em-B) | 0.26 |
| | Yellow coupler (Y-1) | 0.70 |
| | Dye image stabilizer (ST-1) | 0.10 |
| | Dye image stabilizer (ST-2) | 0.10 |
| | Anti-stain agent (HQ-1) | 0.01 |
| | Dye image stabilizer (ST-5) | 0.10 |
| | Image stabilizer A | 0.15 |
| | DNP | 0.05 |
| | DBP | 0.15 |
| 1st layer | Gelatin | 0.5 |
| Support | Polyethylene laminated paper (containing fine amount of coloring agent) | |

Amount of silver halide emulsion was represented in conversion to silver.

SU-1: Sodium tri-i-propyl naphthalene sulfonic acid

SU-2: Sodium salt of sulfosuccinic acid di (2-ethylhexyl

SU-3: Sodium salt of sulfosuccinic acid di (2,2,3,3,4,4,5,5,-octafluoropentyl

DBP: Dibutylphthalate

DNP: Dinonylphthalate

DOP: Dioctylphthalate

DIDP: Di-i-decylphthalate

PVP: Polyvinylpyrrolidone

H-1: Tetrakis (vinylsulfonylmethyl)methane

H-2: Sodium 2,4-dichloro-6-hydroxy-s-triazine

HQ-1: 2,5-di-t-octyl hydroquinone

HQ-2: 2,5-di-sec-dodecyl hydroquinone

HQ-3: 2,5-di-sec-tetradecyl hydroquinone

HQ-4: 2-sec-dodecyl-5-sec-tetradecyl hydroquinone

HQ-5: 2,5-di (1,1-dimethyl-4-hexyloxycarbonyl)butyl hydroquinone

Image stabilizer A: p-t-octylphenol

Y-1

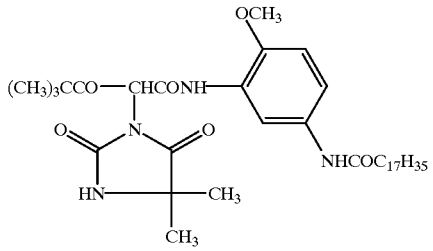

-continued
M-1
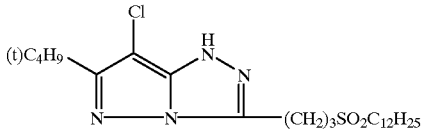
C-1
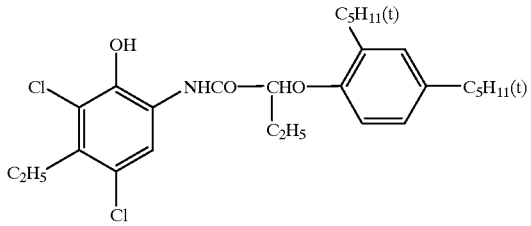
C-2
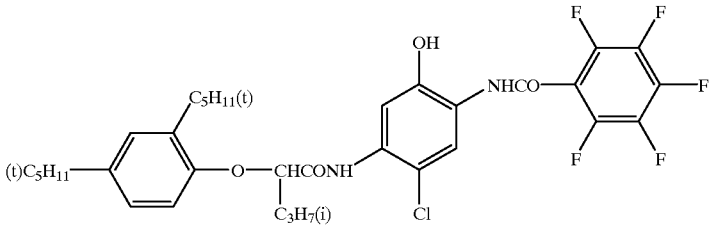
ST-1
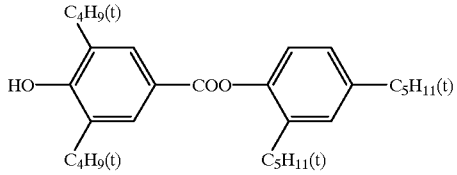
ST-2
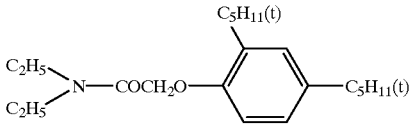
ST-3
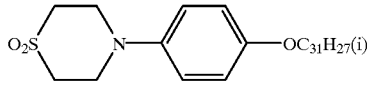
ST-4
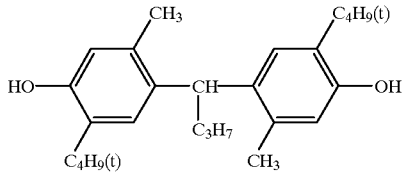
ST-5
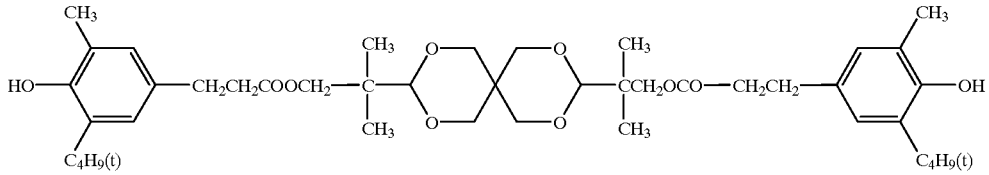

-continued

UV-1

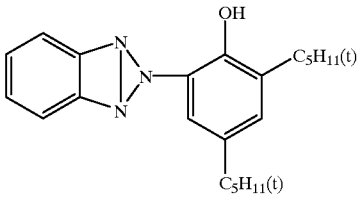

UV-2

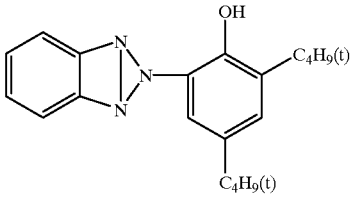

UV-3

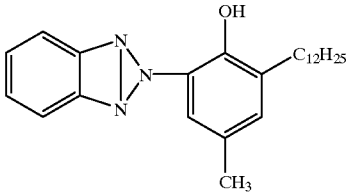

AI-1

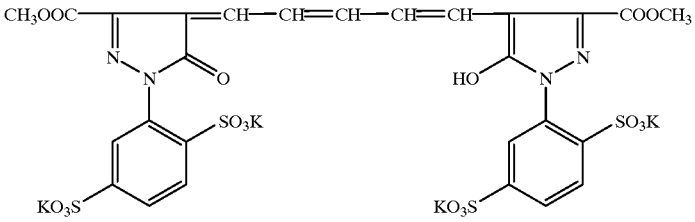

AI-2

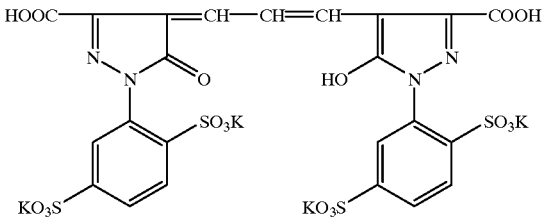

AI-3

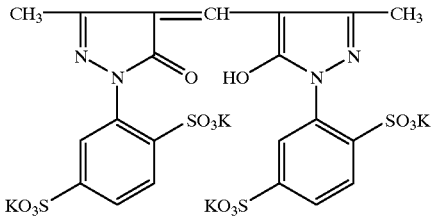

(Preparation of blue sensitive silver halide emulsion Em-B)

In 1 liter of an aqueous 2% gelatin solution kept at 40° C., the following solutions A and B were simultaneously added spending 30 minutes while pAg was regulated to 7.3 and pH was regulated to 3.0. In addition, the following solutions C and D were simultaneously added spending 180 minutes while pAg was regulated to 8.0 and pH was regulated to 5.0. In this occasion, pAg was regulated by a method described in Japanese Patent O.P.I. Publication No. 59-45437, and pH was regulated using sulfuric acid or an aqueous sodium hydroxide solution.

| | |
|---|---|
| (Solution A) | |
| Sodium chloride | 3.42 g |
| Potassium bromide | 0.03 g |
| Water was added to make 200 ml. | |
| (Solution B) | |
| Silver nitrate | 10 g |
| Water was added to make 200 ml. | |
| (Solution C) | |
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Water was added to make 600 ml. | |
| (Solution D) | |
| Silver nitrate | 300 g |
| Water was added to make 600 ml. | |

After finish of addition, the resulting composition was subjected to desalting using an aqueous 5% Demol N produced by Kao Atlas and an aqueous 20% magnesium sulfate solution. Following this, the resulting composition was mixed with an aqueous gelatin solution so that a mono-dispersed cubic emulsion EMP-1 wherein the average grain size was 0.71 $\mu$m, the variation coefficient of grain distribution was 0.07 and silver chloride content was 99.5 mol % was obtained.

Next, a mono-dispersed cubic emulsion EMP-IB was obtained wherein the average grain size was 0.64 $\mu$m, the variation coefficient of grain size distribution was 0.07 and silver chloride content was 99.5 mol % was obtained in the same manner as in EMP-1 except the addition time of Solutions A and B and that of Solutions C and D were changed.

The above-mentioned EMP-1 was subjected to the most suitable chemical sensitization at 60° C. using the following compound. EMP-1B was also subjected to the most suitable chemical sensitization at 60° C. Following this, the sensitized EMP-1 and EMP-1B was mixed at a ratio of 1:1 to obtain a blue sensitive silver halide emulsion (Em-B) was obtained.

| | |
|---|---|
| Sodium thiosulfate | 0.8 mg/mol of Silver halide |
| Chloro aurate | 0.5 mg/mol of Silver halide |
| Stabilizer STAB-1 | $3 \times 10^{-4}$ mol/mol of Silver halide |
| Stabilizer STAB-2 | $3 \times 10^{-4}$ mol/mol of Silver halide |
| Stabilizer STAB-3 | $3 \times 10^{-4}$ mol/mol of Silver halide |
| Sensitizing dye BS-1 | $4 \times 10^{-4}$ mol/mol of Silver halide |
| Sensitizing dye BS-2 | $1 \times 10^{-4}$ mol/mol of Silver halide |

(Preparation of green sensitive silver halide emulsion Em-G)

Next, a mono-dispersed cubic emulsion EMP-2 was obtained wherein the average grain size was 0.40 $\mu$m, the variation coefficient of grain size distribution was 0.08 and silver chloride content was 99.5 mol % was obtained in the same manner as in EMP-1 except the addition time of Solutions A and B and that of Solutions C and D were changed.

Next, a mono-dispersed cubic emulsion EMP-2B was obtained wherein the average grain size was 0.50 $\mu$m, the variation coefficient of grain size distribution was 0.08 and silver chloride content was 99.5 mol % was obtained in the same manner as in EMP-2.

The above-mentioned EMP-2 was subjected to the most suitable chemical sensitization at 55° C. using the following compound. EMP-2B was also subjected to the most suitable chemical sensitization. Following this, the sensitized EMP-2 and EMP-2B was mixed at a ratio of 1:1 to obtain a green sensitive silver halide emulsion (Em-G) was obtained.

| | |
|---|---|
| Sodium thiosulfate | 1.5 mg/mol of Silver halide |
| Chloro aurate | 1.0 mg/mol of Silver halide |
| Stabilizer STAB-1 | $3 \times 10^{-4}$ mol/mol of Silver halide |
| Stabilizer STAB-2 | $3 \times 10^{-4}$ mol/mol of Silver halide |
| Stabilizer STAB-3 | $3 \times 10^{-4}$ mol/mol of Silver halide |
| Sensitizing dye GS-1 | $4 \times 10^{-4}$ mol/mol of Silver halide |

(Preparation of red sensitive silver halide emulsion Em-R)

Next, a mono-dispersed cubic emulsion EMP-3 was obtained wherein the average grain size was 0.40 $\mu$m, the variation coefficient of grain size distribution was 0.08 and silver chloride content was 99.5 mol % was obtained in the same manner as in EMP-1 except the addition time of Solutions A and B and that of Solutions C and D were changed. Next, a mono-dispersed cubic emulsion EMP-2B was obtained wherein the average grain size was 0.38 $\mu$m, the variation coefficient of grain size distribution was 0.08 and silver chloride content was 99.5 mol % was obtained in the same manner as in EMP-3B.

The above-mentioned EMP-3 was subjected to the most suitable chemical sensitization at 60° C. using the following compound. EMP-3B was also subjected to the most suitable chemical sensitization. Following this, the sensitized EMP-3 and EMP-3B was mixed at a ratio of 1:1 to obtain a green sensitive silver halide emulsion (Em-R) was obtained.

| | |
|---|---|
| Sodium thiosulfate | 1.8 mg/mol of Silver halide |
| Chloro aurate | 2.0 mg/mol of Silver halide |
| Stabilizer STAB-1 | $3 \times 10^{-4}$ mol/mol of Silver halide |
| Stabilizer STAB-2 | $3 \times 10^{-4}$ mol/mol of Silver halide |
| Stabilizer STAB-3 | $3 \times 10^{-4}$ mol/mol of Silver halide |
| Sensitizing dye RS-1 | $1 \times 10^{-4}$ mol/mol of Silver halide |
| Sensitizing dye RS-2 | $1 \times 10^{-4}$ mol/mol of Silver halide |

In addition, SS-1 was added to the red sensitive emulsion by $2.0 \times 10^{-3}$ per mol of silver halide.

STAB-1: 1-(3-acetoamidephenyl)-5-mercaptotetrazole

STAB-2: 1-phenyl-5-mercapto tetrazole

STAB-3: 1-(4-ethoxyphenyl)-5-mercapto tetrazole

BS-1

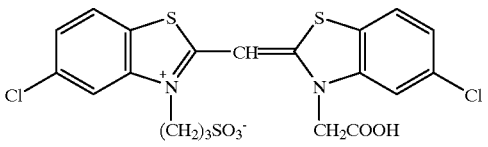

-continued

BS-2

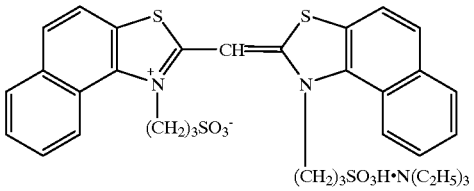

GS-1

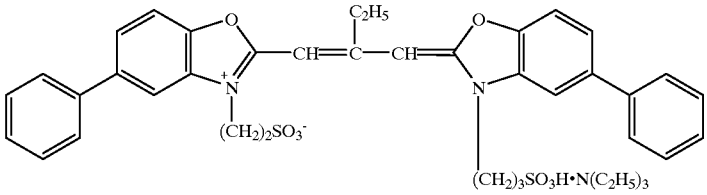

RS-1

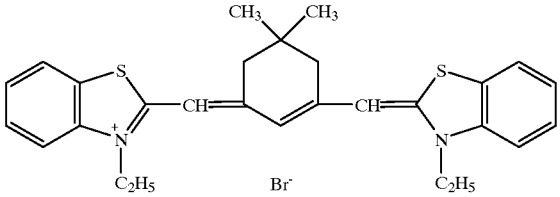

RS-2

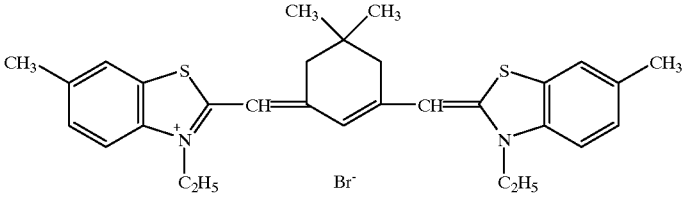

SS-1

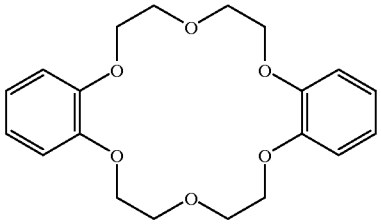

A sample prepared in the above-mentioned manner was defined to be Sample 101.

Then, Samples 102 to 104 were prepared in the same manner as in Sample 101 except that the water soluble fluorescent whitening agent W-1 shown below was added in the first layer.

The amount of the water soluble fluorescent whitening agent W-1 was 0.1 g/m$^2$ for Sample 102, 0.2 g/m$^2$ for Sample 103 and 0.3 g/m$^2$ for Sample 104.

W-1

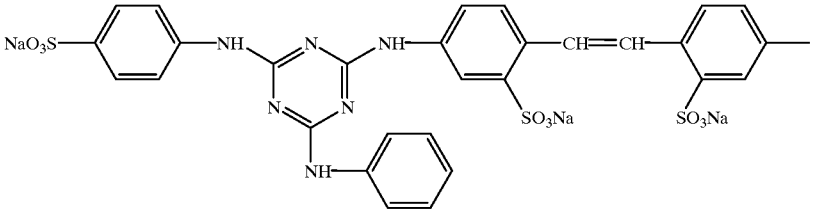

-continued

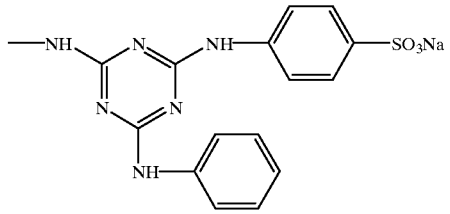

In addition, Samples 105 to 107 were prepared in the same way as Sample 101 except that the oil soluble fluorescent whitening agent W-2 was added in the first layer as dispersion liquid prepared by the following emulsifying dispersion method.

The amount of the oil soluble fluorescent whitening agent W-2 was 0.1 g/m$^2$ for Sample 105, 0.2 g/m$^2$ for Sample 106 and 0.3 g/m$^2$ for Sample 107.

Method of emulsifying dispersion of oil soluble fluorescent whitening agent W-2

Oil soluble fluorescent whitening agent W-2 in amount of 40 g dissolved in 80 g of dioctylphthalate and 100 ml of ethylacetate was mixed with 7% gelatin solution to which 20 ml of 10% surfactant SU-1 was added at 50° C., and then was emulsified by use of mantongauring homogenizer. Finally water was added to the resulted dispersion to be 1000 ml to obtain dispersion of oil soluble fluorescent whitening agent W-2.

Average particle size of oil drops of the obtained emulsified dispersion was 0.2 $\mu$m.

W-2

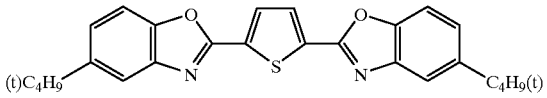

Samples 108 to 110 were prepared in the same way as Sample 101 except that the exemplified compound according to the invention F-10 was added as in the first layer solid particles dispersion liquid prepared by the following solid particles dispersion method.

The amount of the exemplified compound according to the invention F-10 was 0.1 g/m$^2$ for Sample 108, 0.2 g/m$^2$ for Sample 109 and 0.3 g/m$^2$ for Sample 110.

Method of solid fine particles dispersion of the exemplified compound according to the invention F-10

Exemplified compound according to the invention F-10 in amount of 200 g was added to 750 ml of deionized water, then 30 ml of 10% nonionic surfactant polyoxyethylene(10 mol adducted)nonylphenylether solution was added thereto. The temperature was regulated at 40° C., and then the mixture was dispersed at 8000 rpm for 60 minutes by use of high speed agitating dispersion machine. Finally water was added to the resulted dispersion to be 1000 ml to obtain solid fine particles dispersion liquid of F-10.

Average particle size of the obtained solid fine particles was 0.5 $\mu$m.

In addition, Samples 111 to 123 were prepared in the same way as Sample 109 except that the exemplified compound F-10 was replaced by the compound according to the invention shown in Table 3.

The exemplified compounds shown in Table 3 were emulsified by the solid fine particles dispersion method so as to have the average particle size shown in Table 3.

The following evaluation was performed for the samples 101–123 thus prepared.

Evaluation of whiteness

Unexposed samples were processed by the following Development Process A to prepare evaluation samples.

Reflective density of each sample was measured by a color analyzer (Model 607, product by Hitachi Ltd.)

Reflective density at wave length of 440 nm ($D_{440}$) and bright value (L*) were measured for the standard of whiteness.

The smaller value of the reflective density $D_{440}$ and the larger value of the bright value (L*) show better characteristics.

The result is shown in Table 3.

Evaluation of sharpness

Each sample were exposed by blue, green and red light through an optical wedge having rectangular pattern of various frequency in contact with the sample, and was processed by the following Development Process A to obtain a yellow rectangular pattern image, a magenta rectangular pattern image and a cyan rectangular pattern image. Density difference $\Delta D_0$ between high density part and low density part at a portion having wide areas of higher exposure portion and lower exposed portion without recurrence of rectangular patter and density difference $\Delta D_5$ between high density part and low density part at a portion having rectangular spacial frequency of 3 lines/mm were measured by means of a microdensitometer (Model PDM-5D, Product by Konica Corporation). CFT value ($\Delta D_5/\Delta D_0$) was obtained for yellow (Y), magenta (M) and cyan (C) images. The higher CFT value shows better sharpness.

The result is shown in Table 3.

Developing Process A

| Processing Steps | Processing Temperature | Processing Time | Replenishing Amount |
|---|---|---|---|
| Color Developing | 38.0 ± 0.3° C. | 45 sec. | 80 ml |
| Bleach Fixing | 35.0 ± 0.5° C. | 45 sec. | 120 ml |
| Stabilizing | 30–34° C. | 60 sec. | 150 ml |
| Drying | 60–8O° C. | 30 sec. | |

Composition of the developing composition will be illustrated as below:

Color developing tank composition and replenishing composition

| | Tank composition | Replenishing composition |
|---|---|---|
| Deionized water | 800 ml | 800 ml |
| Triethylene diamine | 2 g | 3 g |

-continued

Color developing tank composition and replenishing composition

| | Tank composition | Replenishing composition |
|---|---|---|
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamide ethyl)-3-methyl-4-aminoaniline sulfate | 6.0 g | 10.0 g |
| N,N-diethyhydroxylamine | 6.8 g | 6.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |
| Potassium carbonate | 30 g | 30 g |

Water was added to make 1 liter in total. Tank composition was adjusted to 10.10; and the replenishing composition was adjusted to 10.60.

Bleach fixing composition and its replenishing composition

| | |
|---|---|
| Deionized water | 800 ml |
| Ferric ammonium dihydride of diethylenetriamine pentaacetic acid | 65 g |

-continued

Bleach fixing composition and its replenishing composition

| | |
|---|---|
| Diethylenetriamine pentaacetic acid | 3.0 g |
| Ammonium thiosulfate (an aqueous 70% solution) | 100 ml |
| 2-amino-5-mercapto-1,3,4-thiadiazole | 2.0 g |
| Ammonium sulfite (an aqueous 40% solution) | 27.5 ml |

Water was added to make 1 liter in total, and pH was adjusted to 5.0 using potassium carbonate or glacial acetic acid.

Stabilizing composition and its replenishing composition

| | |
|---|---|
| Deionized water | 800 ml |
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| Fluorescent brightening agent (Chinopal SFP) | 2.0 g |
| 1-hydroxyethylidene-1,1-disulfonic acid | 1.8 g |
| Bismuth chloride (an aqueous 45% solution) | 0.65 g |
| Magnesium sulfate heptahydride | 0.2 g |
| Polyvinylpyrrolidone | 1.0 g |
| Aqueous ammonia (an aqueous 25% ammonium hydroxide solution) | 2.5 g |
| Trisodium salt of nitrilo triacetic acid | 1.5 g |

Water was added to make 1 liter in total, and pH was adjusted to 7.5 using sulfuric acid or aqueous ammonia.

TABLE 3

| Sample No. | Fluorescent whitening Compound | Fluorescent whitening Amount ($g/m^2$) | Dispersion Particle Size | Whiteness Reflective Density $D_{440}$ | Whiteness Bright Value L* | Sharpness, CTF Y | Sharpness, CTF M | Sharpness, CTF C | Remarks |
|---|---|---|---|---|---|---|---|---|---|
| 101 | — | — | — | 0.099 | 90.01 | 0.75 | 0.74 | 0.71 | Comp. |
| 102 | W-1 | 0.1 | — | 0.094 | 90.02 | 0.73 | 0.73 | 0.71 | Comp. |
| 103 | W-1 | 0.2 | — | 0.093 | 90.03 | 0.73 | 0.73 | 0.70 | Comp. |
| 104 | W-1 | 0.3 | — | 0.092 | 90.03 | 0.72 | 0.73 | 0.70 | Comp. |
| 105 | W-2 | 0.1 | 0.2 Oil drop | 0.093 | 90.08 | 0.74 | 0.73 | 0.71 | Comp. |
| 106 | W-2 | 0.2 | 0.2 Oil drop | 0.092 | 90.08 | 0.74 | 0.73 | 0.70 | Comp. |
| 107 | W-2 | 0.3 | 0.2 Oil drop | 0.091 | 90.00 | 0.73 | 0.73 | 0.70 | Comp. |
| 108 | F-10 | 0.1 | 0.5 | 0.074 | 90.41 | 0.81 | 0.79 | 0.76 | Inv. |
| 109 | F-10 | 0.2 | 0.5 | 0.068 | 90.50 | 0.83 | 0.80 | 0.77 | Inv. |
| 110 | F-10 | 0.3 | 0.5 | 0.060 | 90.52 | 0.85 | 0.82 | 0.79 | Inv. |
| 111 | F-1 | 0.2 | 0.8 | 0.077 | 90.38 | 0.78 | 0.76 | 0.74 | Inv. |
| 112 | F-2 | 0.2 | 0.7 | 0.076 | 90.39 | 0.78 | 0.76 | 0.74 | Inv. |
| 113 | F-5 | 0.2 | 0.5 | 0.078 | 90.38 | 0.78 | 0.76 | 0.75 | Inv. |
| 114 | F-6 | 0.2 | 0.6 | 0.079 | 90.31 | 0.78 | 0.76 | 0.75 | Inv. |
| 115 | F-7 | 0.2 | 1.1 | 0.082 | 90.29 | 0.78 | 0.76 | 0.74 | Inv. |
| 116 | F-8 | 0.2 | 0.4 | 0.069 | 90.50 | 0.81 | 0.80 | 0.76 | Inv. |
| 117 | F-12 | 0.2 | 0.5 | 0.070 | 90.49 | 0.80 | 0.78 | 0.77 | Inv. |
| 118 | F-14 | 0.2 | 0.5 | 0.070 | 90.48 | 0.80 | 0.79 | 0.76 | Inv. |
| 119 | F-15 | 0.2 | 0.8 | 0.072 | 90.48 | 0.81 | 0.80 | 0.77 | Inv. |
| 120 | F-16 | 0.2 | 0.7 | 0.071 | 90.48 | 0.82 | 0.80 | 0.77 | Inv. |
| 121 | F-17 | 0.2 | 0.5 | 0.071 | 90.49 | 0.83 | 0.80 | 0.76 | Inv. |

TABLE 3-continued

| Sample No. | Fluorescent whitening Compound | Amount ($g/m^2$) | Dispersion Particle Size | Whiteness Reflective Density $D_{440}$ | Bright Value L* | Sharpness, CTF Y | M | C | Remarks |
|---|---|---|---|---|---|---|---|---|---|
| 122 | F-18 | 0.2 | 0.3 | 0.071 | 90.48 | 0.82 | 0.80 | 0.76 | Inv. |
| 123 | F-20 | 0.2 | 0.5 | 0.070 | 90.50 | 0.82 | 0.80 | 0.76 | Inv. |

Comp: Comparative, Inv.: Inventive

The results shown in Table 3 illustrate that the silver light sensitive photographic material of the invention is proved to show excellent whiteness having high fluorescent effect $D_{440}$ and improved in bright value, and improved sharpness.

Example 2

Whiteness evaluation was conducted for Samples 101–123 described in Example 1 in the same way as Example 1 except that Color Developing Process B was used in replace of Color Developing Process A.

The result is shown in Table 4.

Developing Process B

| Processing Steps | Processing Temperature | Processing Time | Replenishing Amount |
|---|---|---|---|
| Color Developing | 38.0 ± 0.3° C. | 45 sec. | 80 ml |
| Bleach Fixing | 35.0 ± 0.5° C. | 45 sec. | 120 ml |
| Stabilizing | 30–34° C. | 60 sec. | 150 ml |
| Drying | 60–80° C. | 30 sec. | |

Composition of the developing composition will be illustrated as below:

Color developing tank composition and replenishing composition

| | Tank composition | Replenishing composition |
|---|---|---|
| Deionized water | 800 ml | 800 ml |
| Triethylene diamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamide ethyl)-3-methyl-4-aminoaniline sulfate | 6.0 g | 10.0 g |
| N,N-diethyhydroxylamine | 6.8 g | 6.0 g |
| Triethanolamine | 10.0 g | 10.0 g |
| Sodium salt of diethylenetriamine pentaacetic acid | 2.0 g | 2.0 g |
| Potassium carbonate | 30 g | 30 g |

Water was added to make 1 liter in total. Tank composition was adjusted to 10.10, and the replenishing composition was adjusted to 10.60.

Bleach fixing composition and its replenishing composition

| | |
|---|---|
| Deionized water | 800 ml |
| Ferric ammonium dihydride of diethylenetriamine pentaacetic acid | 65 g |
| Diethylenetriamine pentaacetic acid | 3.0 g |
| Ammonium thiosulfate (an aqueous 70% solution) | 100 ml |
| 2-amino-5-mercapto-1,3,4-thiadiazole | 2.0 g |
| Ammonium sulfite (an aqueous 40% solution) | 27.5 ml |

Water was added to make 1 liter in total, and pH was adjusted to 5.0 using potassium carbonate or glacial acetic acid.

Stabilizing composition and its replenishing composition

| | |
|---|---|
| Deionized water | 800 ml |
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| 1-hydroxyethylidene-1,1-disulfonic acid | 1.8 g |
| Bismuth chloride (an aqueous 45% solution) | 0.65 g |
| Magnesium sulfate heptahydride | 0.2 g |
| Polyvinylpyrrolidone | 1.0 g |
| Aqueous ammonia (an aqueous 25% ammonium hydroxide solution) | 2.5 g |
| Trisodium salt of nitrilo triacetic acid | 1.5 g |

Water was added to make 1 liter in total, and pH was adjusted to 7.5 using sulfuric acid or aqueous ammonia.

TABLE 4

| Sample No. | Whiteness Reflective Density $D_{440}$ | Bright Value L* | Sharpness, CTF Y | M | C | Remarks |
|---|---|---|---|---|---|---|
| 101 | 0.106 | 90.11 | 0.77 | 0.74 | 0.71 | Comparative |
| 102 | 0.099 | 90.12 | 0.73 | 0.73 | 0.71 | Comparative |
| 103 | 0.098 | 90.12 | 0.73 | 0.73 | 0.70 | Comparative |
| 104 | 0.096 | 90.12 | 0.72 | 0.73 | 0.70 | Comparative |
| 105 | 0.096 | 90.15 | 0.74 | 0.73 | 0.71 | Comparative |
| 106 | 0.094 | 90.16 | 0.74 | 0.73 | 0.70 | Comparative |
| 107 | 0.094 | 90.16 | 0.73 | 0.73 | 0.70 | Comparative |
| 108 | 0.078 | 90.50 | 0.81 | 0.79 | 0.76 | Inventive |
| 109 | 0.072 | 90.60 | 0.83 | 0.80 | 0.77 | Inventive |
| 110 | 0.064 | 90.67 | 0.85 | 0.82 | 0.79 | Inventive |
| 111 | 0.079 | 90.48 | 0.78 | 0.76 | 0.74 | Inventive |
| 112 | 0.079 | 90.45 | 0.78 | 0.76 | 0.74 | Inventive |

TABLE 4-continued

| Sample No. | Whiteness: Reflective Density $D_{440}$ | Whiteness: Bright Value L* | Sharpness, CTF: Y | Sharpness, CTF: M | Sharpness, CTF: C | Remarks |
|---|---|---|---|---|---|---|
| 113 | 0.081 | 90.44 | 0.78 | 0.76 | 0.75 | Inventive |
| 114 | 0.081 | 90.39 | 0.78 | 0.76 | 0.75 | Inventive |
| 115 | 0.084 | 90.32 | 0.78 | 0.76 | 0.74 | Inventive |
| 116 | 0.072 | 90.60 | 0.81 | 0.80 | 0.76 | Inventive |
| 117 | 0.073 | 90.58 | 0.80 | 0.78 | 0.77 | Inventive |
| 118 | 0.073 | 90.57 | 0.80 | 0.79 | 0.76 | Inventive |
| 119 | 0.076 | 90.58 | 0.81 | 0.80 | 0.77 | Inventive |
| 120 | 0.074 | 90.55 | 0.82 | 0.80 | 0.77 | Inventive |
| 121 | 0.073 | 90.52 | 0.83 | 0.80 | 0.76 | Inventive |
| 122 | 0.074 | 90.60 | 0.82 | 0.80 | 0.76 | Inventive |
| 123 | 0.073 | 90.60 | 0.82 | 0.80 | 0.76 | Inventive |

Results shown in Table 3 demonstrate the silver halide photographic light sensitive materials of the invention give excellent whiteness in case that the fluorescent whitening agent is removed from the processing composition.

Example 3

Whiteness evaluation w as conducted for Samples 101–123 described in Example 1 in the same way as Example 1 except that Color Developing Process C was used in replace of Color Developing Process A. The effect of the invention was observed.

Developing Process C

| Processing Steps | Processing Temperature | Processing Time | Replenishing Amount |
|---|---|---|---|
| Color Developing | 38.0 ± 0.3° C. | 22 sec. | 81 ml |
| Bleach Fixing | 35.0 ± 0.5° C. | 22 sec. | 54 ml |
| Stabilizing | 30–34° C. | 25 sec. | 150 ml |
| Drying | 60–80° C. | 30 sec. | |

Composition of the developing composition will be illustrated as below:

Color developing tank composition and replenishing composition

| | Tank composition | Replenishing composition |
|---|---|---|
| Deionized water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamide ethyl)-3-methyl-4-aminoaniline sulfate | 6.5 g | 10.5 g |
| N,N-diethyhydroxylamine | 3.5 g | 6.0 g |
| N,N-bis(2-sulfoethyl)hydroxyamine | 3.5 g | 6.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |
| Potassium carbonate | 30 g | 30 g |

Water was added to make 1 liter in total. Tank composition was adjusted to 10.10, and the replenishing composition was adjusted to 10.60.

Bleach fixing composition and its replenishing composition

| | Tank composition | Replenishing composition |
|---|---|---|
| Deionized water | 700 ml | 700 ml |
| Ferric ammonium dihydride of diethylenetriamine pentaacetic acid | 100 g | 50 g |
| Diethylenetriamine pentaacetic acid | 3.0 g | 3.0 g |
| Ammonium thiosulfate (an aqueous 70% solution) | 200 ml | 100 ml |
| 2-amino-5-mercapto-1,3,4-thiadiazole | 2.0 g | 1.0 g |
| Ammonium sulfite (an aqueous 40% solution) | 50 ml | 25 ml |

Water was added to make 1 liter in total, and pH was adjusted to 7.0 for tank composition and 6.5 for replenisher composition using potassium carbonate or glacial acetic acid.

Stabilizing composition and its replenishing composition

| | |
|---|---|
| Deionized water | 800 ml |
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| Fluorescent brightening agent (Chinopal SFP) | 2.0 g |
| 1-hydroxyethylidene-1,1-disulfonic acid | 1.8 g |
| Bismuth chloride (an aqueous 45% solution) | 0.65 g |
| Magnesium sulfate heptahydride | 0.2 g |
| Polyvinylpyrrolidone | 1.0 g |
| Aqueous ammonia (an aqueous 25% ammonium hydroxide solution) | 2.5 g |
| Ethylenediamine tetraacetic acid | 1.0 g |
| Ammonium sulfate (an aqueous 40% solution) | 10 ml |

Water was added to make 1 liter in total, and pH was adjusted to 7.5 using sulfuric acid or aqueous ammonia.

Example 4

In Example 3, it was observed that the invention was effective in the whiteness evaluation by the process according to Process CPK-2J1 using NPS-868J (Product by Konica Corporation) as an automatic developing processor and ECOJET-P as processing chemicals.

Example 5

Whiteness evaluation was conducted for Samples 101–123 described in Example 1 in the same way as Example 1 except that Color Developing Process D was used in replace of Color Developing Process A. The same effect of the invention was observed.

Developing Process D

| Processing Steps | Processing Temperature | Processing Time | Replenishing Amount |
|---|---|---|---|
| Color Developing | 38.0 ± 0.3° C. | 22 sec. | 81 ml |
| Bleach Fixing | 35.0 ± 0.5° C. | 22 sec. | 54 ml |
| Stabilizing | 30–34° C. | 25 sec. | 150 ml |
| Drying | 60–80° C. | 30 sec. | |

Composition of the developing composition will be illustrated as below:

Color developing tank composition and replenishing composition

| | Tank composition | Replenishing composition |
|---|---|---|
| Deionized water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-β-methanesulfonamide ethyl)-3-methyl-4-aminoaniline sulfate | 6.5 g | 10.5 g |
| N,N-diethyhydroxylamine | 3.5 g | 6.0 g |
| N,N-bis(2-sulfoethyl)hydroxyamine | 3.5 g | 6.0 g |
| Triethanolamine | 10.0 g | 10.0 g |
| Sodium salt of diethylenetriamine pentaacetic acid | 2.0 g | 2.0 g |
| Potassium carbonate | 30 g | 30 g |

Water was added to make 1 liter in total. Tank composition was adjusted to 10.10, and the replenishing composition was adjusted to 10.60.

Bleach fixing composition and its replenishing composition

| | Tank composition | Replenishing composition |
|---|---|---|
| Deionized water | 700 ml | 700 ml |
| Ferric ammonium dihydride of diethylenetriamine pentaacetic acid | 100 g | 50 g |
| Diethylenetriamine pentaacetic acid | 3.0 g | 3.0 g |
| Ammonium thiosulfate (an aqueous 70% solution) | 200 ml | 100 ml |
| 2-amino-5-mercapto-1,3,4-thiadiazole | 2.0 g | 1.0 g |
| Ammonium sulfite (an aqueous 40% solution) | 50 ml | 25 ml |

Water was added to make 1 liter in total, and pH was adjusted to 7.0 for tank composition and 6.5 for replenisher composition using potassium carbonate or glacial acetic acid.

Stabilizing composition and its replenishing composition

| | |
|---|---|
| Deionized water | 800 ml |
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| 1-hydroxyethylidene-1,1-disulfonic acid | 1.8 g |
| Polyvinylpyrrolidone | 1.0 g |
| Aqueous ammonia (an aqueous 25% ammonium hydroxide solution) | 2.5 g |

-continued

Stabilizing composition and its replenishing composition

| | |
|---|---|
| Ethylenediamine tetraacetic acid | 1.0 g |
| Ammonium sulfate (an aqueous 40% solution) | 10 ml |

Water was added to make 1 liter in total, and pH was adjusted to 7.5 using sulfuric acid or aqueous ammonia.

Example 6

Sample 601 was prepared in the same way as Sample 101 of Example 1 except that the first layer of the Sample 101 was replaced by the following S-1 layer which contains white pigment.

S-1 layer (Layer containing white pigment)

| | |
|---|---|
| Gelatin | 1.0 g/m$^2$ |
| Rutile titan oxide | 1.0 g/m$^2$ |

Samples 602–604 were prepared by the same way as Sample 601 except that above mentioned water soluble fluorescent whitening agent W-1 was added to the layer S-1.

The amount of the water soluble fluorescent whitening agent W-1 was 0.1 g/m$^2$ for Sample 601, 0.2 g/m$^2$ for Sample 602 and 0.5 g/m$^2$ for Sample 603.

Samples 605–607 were prepared by the same way as Sample 601 except that the exemplified compound according to the invention F-10 was added as solid particles dispersion liquid prepared by the following solid particles dispersion method.

The amount of the exemplified compound according to the invention F-10 was 0.1 g/m$^2$ for Sample 605, 0.2 g/m$^2$ for Sample 606 and 0.5 g/m$^2$ for Sample 607.

Method of solid fine particles dispersion of the exemplified compound according to the invention F-10

Exemplified compound according to the invention F-10 in amount of 300 g was added to 750 ml of deionized water, then 30 ml of 10% nonionic surfactant polyoxyethylene(10 mol adducted)nonylphenylether solution was added thereto. The temperature was regulated at 40° C., and then the mixture was dispersed at 8000 rpm for 90 minutes by use of high speed agitating dispersion machine. Finally water was added to the resulted dispersion to be 1000 ml to obtain solid fine particles dispersion liquid of F-10.

Average particle size of the obtained solid fine particles was 0.4 $\mu$m.

Whiteness and sharpness were measured for the samples 601 to 607 in the same way as Example 1.

0249 The results are shown in Table 5.

TABLE 5

| Sample No. | Fluorescent whitening Compound | Amount ($g/m^2$) | Dispersion Particle Size | Whiteness Reflective Density $D_{440}$ | Bright Value L* | Sharpness, CTF Y | M | C | Remarks |
|---|---|---|---|---|---|---|---|---|---|
| 601 | — | — | — | 0.110 | 90.21 | 0.81 | 0.79 | 0.76 | Comp. |
| 602 | W-1 | 0.1 | — | 0.100 | 90.22 | 0.80 | 0.78 | 0.76 | Comp. |
| 603 | W-1 | 0.2 | — | 0.100 | 90.22 | 0.79 | 0.78 | 0.76 | Comp. |
| 604 | W-1 | 0.5 | — | 0.099 | 90.24 | 0.79 | 0.78 | 0.75 | Comp. |
| 605 | F-10 | 0.1 | 0.4 | 0.080 | 90.65 | 0.85 | 0.81 | 0.78 | Inv. |
| 606 | F-10 | 0.2 | 0.4 | 0.073 | 90.69 | 0.86 | 0.83 | 0.80 | Inv. |
| 607 | F-10 | 0.5 | 0.4 | 0.065 | 90.72 | 0.88 | 0.85 | 0.82 | Inv. |

Comp: Comparative, Inv.: Inventive

The results shown in Table 5 illustrate that the silver halide light sensitive photographic material of the invention is proved to show excellent whiteness having high fluorescent effect $D_{440}$ and improved in bright value, and improvedsharpness.

Example 7

Sample 701 was prepared in the same way as Sample 103 of Example 1 except that the following white pigment containing layer W-1 was provided between the support and the first layer of the Sample 103.

| W-1 layer (Layer containing white pigment) | |
|---|---|
| Gelatin | 1.0 $g/m^2$ |
| Anatase titanium oxide | 1.0 $g/m^2$ |

Samples 702 was prepared by the same way as Sample 109 of Example 1 except that above mentioned white pigment containing layer W-1 was provided between the support and the first layer of the Sample 109.

Whiteness and sharpness were measured for the samples 701 and 702 in the same way as Example 1.

The results are shown in Table 6.

TABLE 6

| Sample No. | Fluorescent whitening Compound | Amount ($g/m^2$) | Dispersion Particle Size | Whiteness Reflective Density $D_{440}$ | Bright Value L* | Sharpness, CTF Y | M | C | Remarks |
|---|---|---|---|---|---|---|---|---|---|
| 701 | W-1 | 0.2 | — | 0.102 | 90.30 | 0.77 | 0.77 | 0.77 | Comp. |
| 702 | F-10 | 0.2 | 0.5 | 0.075 | 90.72 | 0.86 | 0.82 | 0.80 | Inv. |

Comp: Comparative, Inv.: Inventive

The results shown in Table 6 illustrate that the silver halide light sensitive photographic material of the invention is proved to show excellent whiteness having high fluorescent effect $D_{440}$ and improved in bright value, and improvedsharpness.

Example 8

Sample 801 was prepared in the same way as Sample 103 of Example 1 except that the following black colloid containing layer B-1 was provided between the support and the first layer of the Sample 103.

| B-1 layer (Layer containing black colloid) | |
|---|---|
| Gelatin | 1.0 $g/m^2$ |
| Black colloidal silver | 0.1 $g/m^2$ |

Samples 802 was prepared by the same way as Sample 109 of Example 1 except that above mentioned black colloid containing layer B-1 was provided between the support and the first layer of the Sample 109.

Whiteness and sharpness were measured for the samples 801 and 802 in the same way as Example 1.

0261 The results are shown in Table 7.

TABLE 7

| Sample No. | Fluorescent whitening Compound | Amount ($g/m^2$) | Dispersion Particle Size | Whiteness Reflective Density $D_{440}$ | Whiteness Bright Value L* | Sharpness, CTF Y | Sharpness, CTF M | Sharpness, CTF C | Remarks |
|---|---|---|---|---|---|---|---|---|---|
| 801 | W-1 | 0.2 | — | 0.105 | 89.70 | 0.79 | 0.78 | 0.76 | Comp. |
| 802 | F-10 | 0.2 | 0.5 | 0.073 | 90.45 | 0.87 | 0.83 | 0.81 | Inv. |

Comp: Comparative, Inv.: Inventive

The results shown in Table 7 illustrate that the silver halide light sensitive photographic material of the invention is proved to show excellent whiteness having high fluorescent effect $D_{440}$ and improved in bright value, and improvedsharpness.

Example 9

Sample 901 was prepared in the same way as Sample 101 of Example 1 except that the first layer (lowermost layer) was replaced by the following WB-1 layer (a layer containing white pigment and colloidal silver) and that the following G-1 layer (an intermediate layer) was provided between the WB-1 layer and the second layer (blue sensitive layer) of the Sample 101.

| WB-1 layer (Layer containing white pigment and black colloidal silver) | |
|---|---|
| Gelatin | 1.0 $g/m^2$ |
| Rutile titanium oxide | 1.0 $g/m^2$ |
| Black colloidal silver | 0.1 $g/m^2$ |
| G-1 layer (Intermediate layer) | |
| Gelatin | 0.5 $g/m^2$ |

Samples 902 was prepared by the same way as Sample 901 except that above mentioned oil soluble fluorescent whitening agent W-2 was added in an amount of 0.2 $g/m^2$ as a dispersion prepared by the emulsifying dispersion method described in Example 1 to the intermediate layer G-1 of the Sample 109.

Samples 903 was prepared by the same way as Sample 901 except that exemplified compound of the invention F-10 was added in an amount of 0.2 $g/m^2$ as solid dispersion prepared by the solid dispersion method described in Example 1 to the intermediate layer G-1 of the Sample 109.

Whiteness and sharpness were measured for the samples 801 to 903 in the same way as Example 1.

The results are shown in Table 8.

TABLE 8

| Sample No. | Fluorescent whitening Compound | Amount ($g/m^2$) | Dispersion Particle Size | Whiteness Reflective Density $D_{440}$ | Whiteness Bright Value L* | Sharpness, CTF Y | Sharpness, CTF M | Sharpness, CTF C | Remarks |
|---|---|---|---|---|---|---|---|---|---|
| 901 | — | — | — | 0.112 | 89.64 | 0.83 | 0.81 | 0.78 | Comp. |
| 902 | W-2 | 0.2 | 0.2 | 0.109 | 89.73 | 0.81 | 0.81 | 0.78 | Comp. |
| 903 | F-10 | 0.2 | 0.5 | 0.075 | 90.48 | 0.88 | 0.86 | 0.83 | Inv. |

Comp: Comparative, Inv.: Inventive

The results shown in Table 8 illustrate that the silver halide light sensitive photographic material of the invention is proved to show excellent whiteness having high fluorescent effect $D_{440}$ and improved in bright value, and improved sharpness.

Example 10

Preparation of silver halide emulsion EM-P1

An aqueous solution containing ammonia and silver nitrate and an aqueous solution containing potassium bromide and sodium chloride (molar ratio KBr:NaCl=95:5) were added to an aqueous solution containing ocein gelatin simultaneously by a method of controlled double jet controlling the temperature at 40° C. to obtain a cubic silver-chlorobromide core emulsion having average grain size of 0.30 $\mu$m. During the preparation pH and pAg were controlled so as to obtain cubic grain shape.

An aqueous solution containing ammonia and silver nitrate and an aqueous solution containing potassium bromide and sodium chloride (molar ratio KBr:NaCl=40:60) were added to the core emulsion simultaneously by a method of controlled double jet to make the grain grown up to average grain size of 0.42 μm. During the preparation pH and pAg were controlled so as to obtain cubic grain shape.

The resulted silver halide emulsion was washed with water to remove water soluble salts, and after that gelatin was added to obtain the emulsion EM-P1. The width of grain size distribution of EM-P1 was 8%.

Preparation of silver halide emulsion EM-P2

An aqueous solution containing ammonia and silver nitrate and an aqueous solution containing potassium bromide and sodium chloride (molar ratio KBr:NaCl=95:5) were added to an aqueous solution containing ocein gelatin simultaneously by a method of controlled double jet controlling the temperature at 40° C. to obtain a cubic silver-chlorobromide core emulsion having average grain size of 0.19 μm. During the preparation pH and pAg were controlled so as to obtain cubic grain shape.

An aqueous solution containing ammonia and silver nitrate and an aqueous solution containing potassium bromide and sodium chloride (molar ratio KBr:NaCl=40:60) were added to the core emulsion simultaneously by a method of controlled double jet to make the grain grown up to average grain size of 0.25 μm. During the preparation pH and pAg were controlled so as to obtain cubic grain shape.

The resulted silver halide emulsion was washed with water to remove water soluble salts, and after that gelatin was added to obtain the emulsion EM-P2. The width of grain size distribution of EM-P2 was 8%.

Preparation of blue sensitive silver halide emulsion

Sensitizing dye BS-1 was added to the emulsion EM-P1 to conduct spectral sensitization optimally, then stabilizer T-1 was added in an amount of 600 mg per 1 mol silver. Thus blue sensitive silver halide emulsion Em-B1 was prepared.

Preparation of green sensitive silver halide emulsion

Sensitizing dye GS-1 was added to the emulsion EM-P2 to conduct spectral sensitization optimally, then stabilizer T-1 was added in an amount of 600 mg per 1 mol silver. Thus blue sensitive silver halide emulsion Em-G1 was prepared.

Preparation of red sensitive silver halide emulsion

Sensitizing dye RS-1 and RS-2 were added to the emulsion EM-P2 to conduct spectral sensitization optimally, then stabilizer T-1 was added in an amount of 600 mg per 1 mol silver. Thus blue sensitive silver halide emulsion Em-R1 was prepared.

T-1: 4-Hydroxy-6-methyl-1,3,3a7-tetraazaindene

BS-1

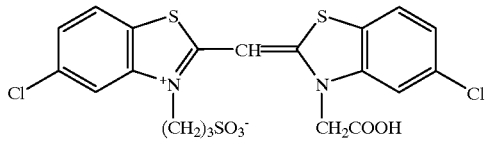

GS-1

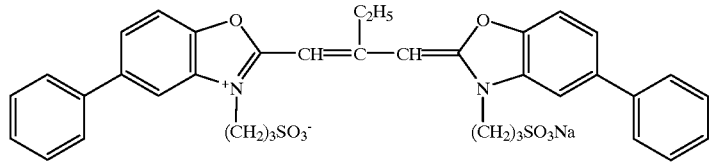

RS-1

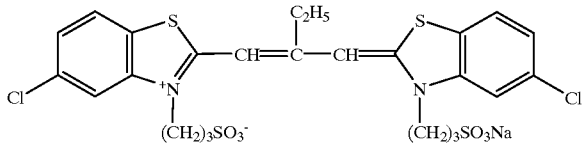

RS-2

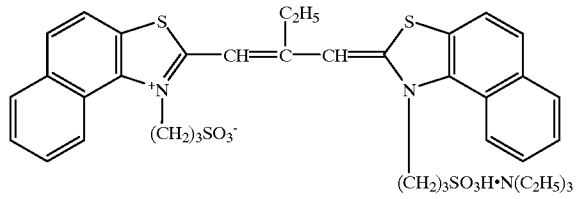

A polyethylene laminated reflective paper support having weight of 125 g/m$^2$ which was prepared by laminating fused polyethylene containing anatase titanium oxide dispersed in the content of 15 weight % on one side and high density polyethylene on the other side of paper pulp whose weight was 180 g/m$^2$. Each layer having the following composition was coated on the side of polyethylene containing dispersed anatase titanium oxide, and 6.00 g/m$^2$ of gelatin and 0.65 g/m$^2$ of silica matting agent were coated on the back side whereby multi-layered color light sensitive material sample 1001 was prepared.

Further, hardening agents H-1 and H-2 were added. Surfactants SU-1, SU-2 and SU-3 were added as coating aid and dispersion aid.

SU-1: Sodium salt of sulfosuccinic acid di(2-ethylhexyl)

SU-2: Sodium salt of sulfosuccinic acid di(2,2,3,3,4,4,5,5-octafluoropentyl

SU-3: Sodium tri-i-propyl naphthalene sulfonic acid

H-1: Sodium 2,4-dichloro-6-hydroxy-s-triazine

H-2: Tetrakis(vinylsulfonylmethyl)methane

Amount of each additive to each layer is shown as coating amount (g/m$^2$), and amount of the silver halide emulsion was shown as converted silver.

| Ninth layer (UV ray absorption layer) | |
|---|---|
| Gelatin | 1.60 |
| UV absorber (UV-1) | 0.070 |
| UV absorber (UV-2) | 0.025 |
| UV absorber (UV-3) | 0.120 |
| Silica matting agent | 0.01 |
| Eighth layer (Blue sensitive layer) | |
| Gelatin | 1.10 |
| Blue sensitive silver bromochloride emulsion (Em-B1) | 0.34 |
| Yellow coupler (Y-1) | 0.19 |
| Yellow coupler (Y-2) | 0.19 |
| Restrainer (mixture of T-1, T-2, and T-3; mol ratio = 1:1:1) | 0.004 |
| Anti-stain agent (HQ-1) | 0.004 |
| High boiling point organic solvent (SO-1) | 0.30 |
| Seventh layer (Intermediate layer) | |
| Gelatin | 1.94 |
| Anti-stain agent (HQ-1 and HQ-2, mixture of same amount) | 0.02 |
| High boiling point organic solvent (SO-2) | 0.05 |
| Anti-irradiation dye (AI-3) | 0.03 |
| Sixth layer (Yellow colloidal silver layer) | |
| Gelatin | 0.45 |
| Yellow colloidal silver | 0.05 |
| Anti-stain agent (HQ-1) | 0.03 |
| High boiling point organic solvent (SO-1) | 0.08 |
| Polyvinylpyrrolidone | 0.04 |
| Fifth layer (Intermediate layer) | |
| Gelatin | 0.45 |
| Anti-stain agent (HQ-2) | 0.014 |
| Anti-stain agent (HQ-3) | 0.014 |
| High boiling point organic solvent (SO-2) | 0.06 |
| Fourth layer (Green sensitive layer) | |
| Gelatin | 1.25 |
| Green sensitive silver bromochloride emulsion (Em-G1) | 0.37 |
| Magenta coupler (M-1) | 0.25 |
| Anti-stain agent (HQ-1) | 0.035 |

-continued

| | |
|---|---|
| Restrainer (mixture of T-1, T-2, and T-3; mol ratio = 1:1:1) | 0.0036 |
| High boiling point organic solvent (SO-1) | 0.38 |
| Third layer (Intermediate layer) | |
| Gelatin | 0.80 |
| Anti-stain agent (HQ-2) | 0.03 |
| Anti-stain agent (HQ-3) | 0.01 |
| Anti-irradiation dye (AI-1) | 0.04 |
| Second layer (Red sensitive layer) | |
| Gelatin | 0.90 |
| Red sensitive silver bromochloride emulsion (Em-R1) | 0.35 |
| Cyan coupler (C-1) | 0.35 |
| Anti-stain agent (HQ-1) | 0.02 |
| Restrainer (mixture of T-1, T-2, and T-3; mol ratio = 1:1:1) | 0.002 |
| High boiling point organic solvent (SO-1) | 0.18 |
| First layer (White pigment containing layer) | |
| Gelatin | 1.20 |
| Liquid paraffin | 0.55 |
| Anti-irradiation dye (AI-2) | 0.05 |
| Titanium dioxide | 0.50 |

Support

Polyethylene laminated paper containing small amount of colorant

SO-1: Trioctylphosphinoxide

SO-2: Di(i-decyl)phthalate

HQ-1: 2,5-di(t-butyl)hydroquinone

HQ-2: 2,5-di((1,1-dimethyl-4-hexyloxycarbonyl)butyl) hydroquinone

HQ-3: 2,5-di-sec-tetradecyl hydroquinone

HQ-4: Mixture of 1:1:2 of 2,5-di-sec-dodecyl hydroquinone, 2,5-di-sec-tetradecyl hydroquinone and 2-sec-dodecyl-5-sec-tetradecyl hydroquinone by weight T-1: 4-Hydroxy-6-methyl-1,3,3a7-tetraazaindene T-2: 1-(3-acetoamidephenyl)-5-mercaptotetrazole T-3: N-benzyladenine

Y-1

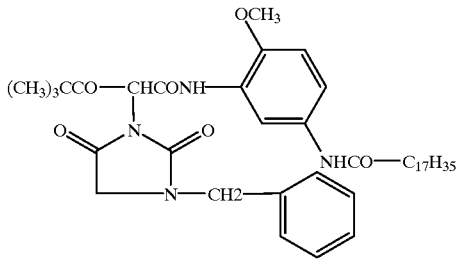

Y-2

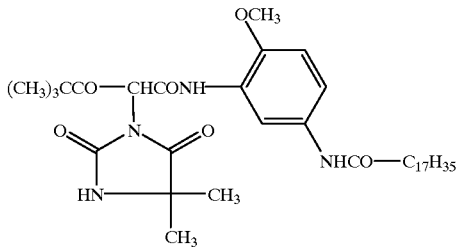

-continued
M-1
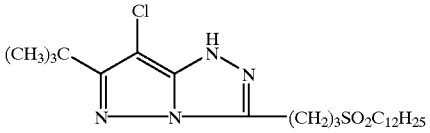
C-1
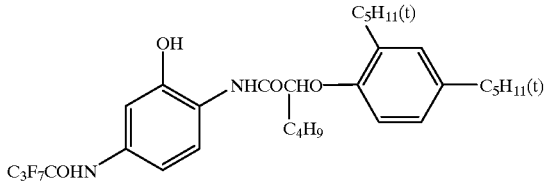
UV-1
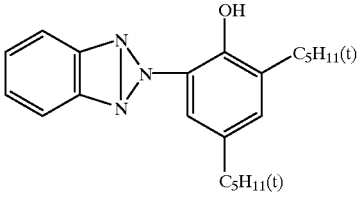
UV-2
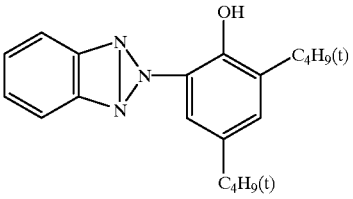
UV-3
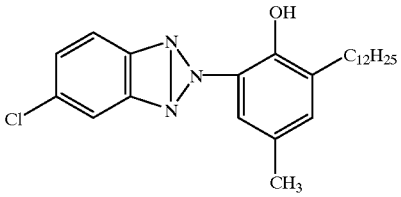
Al-1
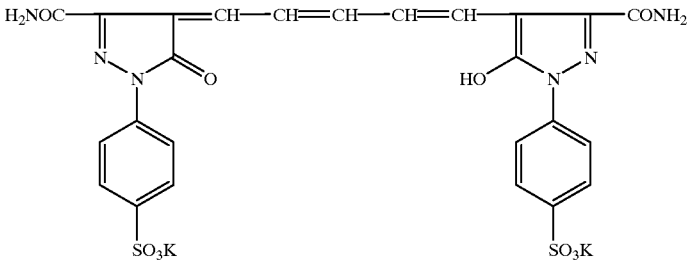
Al-2
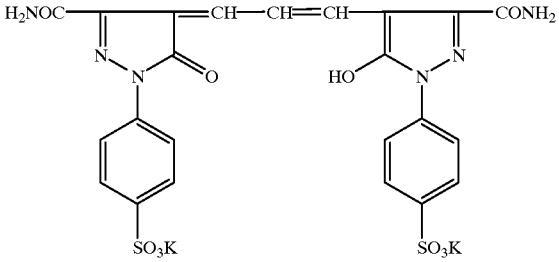

-continued

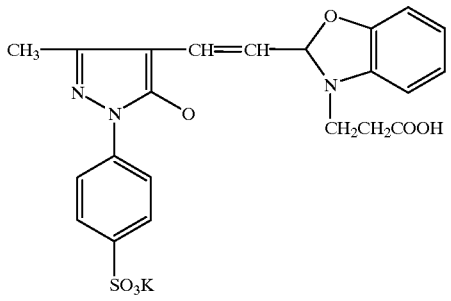

Al-3

Sample 1002 was prepared in the same way as Sample 1001 except that the above mentioned water soluble fluorescent whitening agent W-1 was added to the first layer (white pigment containing layer) in content of 0.3 g/m$^2$.

Sample 1003 was prepared in the same way as Sample 1001 except that the above mentioned oil soluble fluorescent whitening agent W-2 as dispersion dispersed in the same emulsion dispersion method as Example 1 was added to the first layer (white pigment containing layer) in content of 0.3 g/m$^2$.

Sample 1004 was prepared in the same way as Sample 1001 except that the above mentioned exemplified compound of the invention F-10 as solid dispersion dispersed in the same solid dispersion method as Example 1 was added to the first layer (white pigment containing layer) in content of 0.3 g/m$^2$.

Samples 1005–1010 were prepared in the same way as Sample 1004 except that the above mentioned exemplified compound of the invention F-10 was replaced by compounds of the invention shown in Table 9.

The average grain size of the solid dispersion was controlled as shown in Table 9 in the process of dispersing the compounds of the invention in the solid dispersion method.

The obtained samples 1001–1010 were exposed to blue laser corresponding to yellow dot test chart image, green laser corresponding to magenta dot test chart image, red laser corresponding to cyan dot test chart image and admixture of blue, green and red corresponding to black dot test chart image by using laser scan exposure apparatus (Konsensun 570, Product of Konica Corporation).

He—Cd laser (441.6 nm) for blue laser, He—Ne laser (544 nm) for green laser and semiconductor laser (AlGaInAs, about 670 nm) for red laser were used as the laser light source.

Color proof of dot image was prepared by developing processing according to the following Developing Process-1. The processing by the Developing Process-1 was continued so that the total replenishing amount of color developer became up to amount of three times of color developing tank composition.

Developing Process-1

| | Processing Temperature | Processing Time |
|---|---|---|
| Dipping in developer | 37° C. | 12 sec. |
| Fogging exposure | — | 12 sec. |
| Developing | 37° C. | 95 sec. |

-continued

Developing Process-1

| | Processing Temperature | Processing Time |
|---|---|---|
| Bleach Fixing | 35° C. | 45 sec. |
| Stabilizing | 25–30° C. | 90 sec. |
| Drying | 60–85° C. | 40 sec. |

Processing composition is illustrated.

| Developer Composition | |
|---|---|
| Deionized water | 800 ml |
| Benzyl alcohol | 15.0 ml |
| Ceric sulfate | 0.015 g |
| Ethylene glycol | 8.0 ml |
| Potassium sulfite | 2.5 g |
| Potassium bromide | 0.6 g |
| Sodium chloride | 0.2 g |
| Potassium carbonate | 25.0 g |
| T-1 | 0.1 g |
| Hydroxylamine sulfate | 5.0 g |
| Sodium diethylenetriaminepentaacetate | 2.0 g |
| 4-Amino-N-ethyl-N-(β-hydroxyethyl)anilinesulfate | 4.5 g |
| Fluorescent whitening agent (4,4'-diaminostylbenedisulfonic acid derivative) | 1.0 g |
| Potassium hydroxide | 2.0 g |
| Diethylene glycol | 15.0 ml |

Water was added to make 1000 ml in total, and pH was regulated to 10.15.

| Bleach fixing composition | |
|---|---|
| Deionized water | 700 ml |
| Ferric ammonium diethylenetriamine pentaacetic acid | 90.0 g |
| Diethylenetriamine pentaacetic acid | 3.0 g |
| Ammonium thiosulfate (an aqueous 70% solution) | 180.0 ml |
| Ammonium sulfite (an aqueous 40% solution) | 27.5 ml |
| 3-Mercapto-1,2,4-triazole | 0.15 g |

pH was regulated to 7.1 using potassium carbonate or glacial acetic acid, and water was added to make 1000 ml in total.

| Stabilizing composition | |
|---|---|
| Deionized water | 800 ml |
| o-phenylphenol | 0.3 g |
| Potassium sulfite (50% aqueous solution) | 12.0 ml |
| Ethylene glycol | 10.0 g |
| 1-hydroxyethylidene-1,1-diphosfonic acid | 2.5 g |
| Bismuth chloride (an aqueous 45% solution) | 0.2 g |
| Zinc sulfate heptahydride | 0.7 g |
| Ammonium hydroxide (28% aqueous solution) | 2.0 ml |
| 5-chloro-2-methyl-4-isothiazoline-3-on | 0.02 g |
| 2-methyl-4-isothiazoline-3-on | 0.02 g |
| Poly vinyl pyrrolidone (K-17) | 0.2 g |
| Fluorescent whitening agent (4,4'-diaminostylbenedisulfonic acid derivative) | 2.0 g |

Water was added to make 1000 ml in total, and pH was regulated to 7.5 using sulfuric acid or Aqueous ammonia.

The stabilizing process was composed of counter current type two tanks.

Replenishing component for running process.

| Developer Replenisher Composition | |
|---|---|
| Deionized water | 800 ml |
| Benzyl alcohol | 18.5 ml |
| Ceric sulfate | 0.015 g |
| Ethylene glycol | 10.0 ml |
| Potassium sulfite | 2.5 g |
| Potassium bromide | 0.3 g |
| Sodium chloride | 0.2 g |
| Potassium carbonate | 25.0 g |
| T-1 | 0.1 g |
| Hydroxylamine sulfate | 5.0 g |
| Sodium diethylenetriaminepentaacetate | 2.0 g |
| 4-Amino-N-ethyl-N-(β-hydroxyethyl)anilinesulfate | 5.4 g |
| Fluorescent whitening agent (4,4'-diaminostylbenedisulfonic acid derivative) | 1.0 g |
| Potassium hydroxide | 2.0 g |
| Diethylene glycol | 18.0 ml |

Water was added to make 1 litter in total, and pH was regulated to 10.35.

Bleach fixing replenishing composition

The replenishing composition is same as the bleach fixing composition mentioned above.

Stabilizing replenishing composition

The replenishing composition is same as the stabilizing composition mentioned above.

Bleach fixing replenishing composition

The amount of replenisher was set as 320 ml per 1 m2 of the light sensitive material for color developer replenisher, bleach-fixing replenisher and stabilizing replenisher.

Reproducing property of 2% dot for each image thus obtained was measured by human eyes for evaluate sharpness of image.

Standard of dot reproduction property by human eyes was classified as 3 ranks.

1. Inferior
2. Normal
3. Good

The result is shown in Table 9.

TABLE 9

| Sample No. | Fluorescent whitening Compound: Compound | Amount ($g/m^2$) | Dispersion Particle Size | Dot reproduction Y | M | C | Remarks |
|---|---|---|---|---|---|---|---|
| 1001 | — | — | — | 2 | 2 | 2 | Comparative |
| 1002 | W-1 | 0.3 | — | 1 | 2 | 2 | Comparative |
| 1003 | W-2 | 0.3 | 0.2 Oil drop | 1 | 1 | 2 | Comparative |
| 1004 | F-10 | 0.3 | 0.5 | 3 | 3 | 3 | Inventive |
| 1005 | F-1 | 0.3 | 0.8 | 3 | 3 | 3 | Inventive |
| 1006 | F-12 | 0.3 | 0.5 | 3 | 3 | 3 | Inventive |
| 1007 | F-14 | 0.3 | 0.5 | 3 | 3 | 3 | Inventive |
| 1008 | F-15 | 0.3 | 0.8 | 3 | 3 | 3 | Inventive |
| 1009 | F-18 | 0.3 | 0.3 | 3 | 3 | 3 | Inventive |
| 1010 | F-20 | 0.3 | 0.5 | 3 | 3 | 3 | Inventive |

The results shown in Table 9 illustrate that the silver halide light sensitive photographic material of the invention is proved to show excellent 2% dot reproduction of yellow (Y), magenta (M), and cyan (C) and improved dot reproduction, i.e., improved sharpness.

Example 11

Preparation of red sensitive silver halide emulsion

Sensitizing dye IRS-1 and IRS-2 were added to the emulsion EM-P2 mentioned in Example 10 to conduct spectral sensitization optimally, then stabilizer T-1 was added in an amount of 600 mg per 1 mol silver. Thus blue sensitive silver halide emulsion Em-IFR1 was prepared.

A polyethylene laminated reflective paper support having weight of 135 $g/m^2$ which was prepared by laminating fused polyethylene containing anatase titanium oxide dispersed in the content of 15 weight % on one side and high density polyethylene on the other side of paper pulp whose weight was 90 $g/m^2$. Each layer having the following composition was coated on the side of polyethylene containing dispersed anatase titanium oxide, and 6.00 $g/m^2$ of gelatin and 0.65 $g/m^2$ of silica matting agent were coated on the back side whereby multi-layered color light sensitive material sample 1101 was prepared.

Further, hardening agents H-1 and H-2 were added. Surfactants SU-1, SU-2 and SU-3 were added as coating aid and dispersion aid.

IRS-1

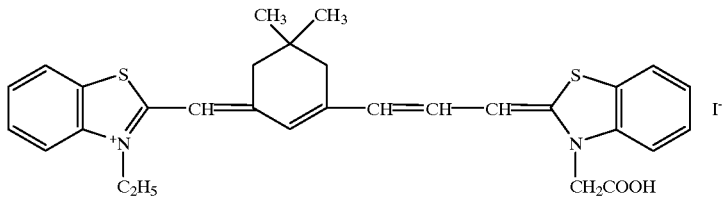

-continued

IRS-2

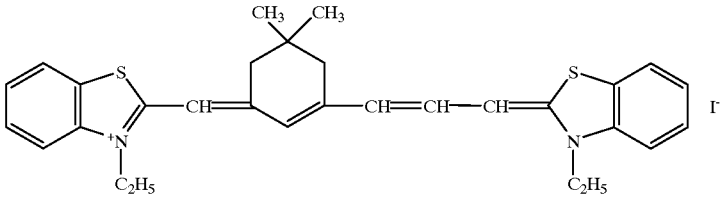

Amount of each additive to each layer is shown as coating amount (g/m$^2$), and amount of the silver halide emulsion was shown as converted silver.

| | |
|---|---|
| Eighth layer (UV ray absorption layer) | |
| Gelatin | 1.60 |
| UV absorber (UV-1) | 0.070 |
| UV absorber (UV-2) | 0.025 |
| UV absorber (UV-3) | 0.120 |
| Silica matting agent | 0.01 |
| Seventh layer (Green sensitive layer) | |
| Gelatin | 1.25 |
| Green sensitive silver bromochloride emulsion (Em-G1) | 0.37 |
| Magenta coupler (M-1) | 0.25 |
| Anti-stain agent (HQ-1) | 0.035 |
| Restrainer (mixture of T-1, T-2, and T-3; mol ratio = 1:1:1) | 0.0036 |
| High boiling point organic solvent (SO-1) | 0.38 |
| Sixth layer (Intermediate layer) | |
| Gelatin | 0.80 |
| Anti-stain agent (HQ-2) | 0.03 |
| Anti-stain agent (HQ-3) | 0.01 |
| High boiling point organic solvent (SO-2) | 0.05 |
| Anti-irradiation dye (AI-1) | 0.04 |
| Fifth layer (Red sensitive layer) | |
| Gelatin | 0.90 |
| Red sensitive silver bromochloride emulsion (Em-R1) | 0.35 |
| Cyan coupler (C-1) | 0.35 |
| Anti-stain agent (HQ-1) | 0.02 |
| Restrainer (mixture of T-1, T-2, and T-3; mol ratio = 1:1:1) | 0.002 |
| High boiling point organic solvent (SO-1) | 0.18 |
| Fourth layer (Intermediate layer) | |
| Gelatin | 0.80 |
| Anti-stain agent (HQ-2) | 0.03 |
| Anti-stain agent (HQ-3) | 0.01 |
| Anti-irradiation dye (AI-2) | 0.05 |
| Third layer (Infrared sensitive layer) | |
| Gelatin | 1.10 |
| Red sensitive silver bromochloride emulsion (Em-IFR1) | 0.34 |
| Yellow coupler (Y-1) | 0.19 |
| Restrainer (mixture of T-1, T-2, and T-3; mol ratio = 1:1:1) | 0.004 |
| Anti-stain agent (HQ-1) | 0.004 |
| High boiling point organic solvent (SO-1) | 0.30 |
| Second layer (Intermediate layer) | |
| Gelatin | 1.20 |
| Anti-irradiation dye (AI-4) | 0.05 |
| First layer (Gray colloidal silver containing layer) | |
| Gelatin | 2.20 |
| Gray colloidal silver | 0.12 |

Support

Polyethylene laminated paper containing small amount of colorant

Al-4

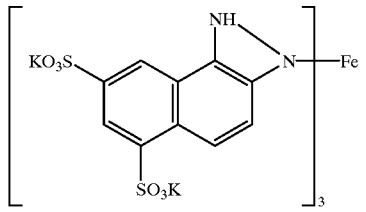

Emulsions Em-G1 and Em-R1 are the same as Emulsions Em-G1 and Em-R1 mentioned in Example 10, respectively.

Sample 1102 was prepared in the same way as Sample 1101 except that the above mentioned water soluble fluorescent whitening agent W-1 was added to the first layer (gray colloidal silver containing layer) in content of 0.3 g/m$^2$.

Sample 1103 was prepared in the same way as Sample 1101 except that the above mentioned exemplified compound of the invention F-10 as solid dispersion dispersed in the same solid dispersion method as Example 1 was added to the first layer (gray colloidal silver containing layer) in content of 0.3 g/m$^2$.

Samples 1104–1107 were prepared in the same way as Sample 1104 except that the above mentioned exemplified compound of the invention F-10 was replaced by compounds of the invention shown in Table 10.

The average grain size of the solid dispersion was controlled as shown in Table 10 in the process of dispersing the compounds of the invention in the solid dispersion method.

The obtained samples 1101–1107 were exposed to blue laser corresponding to yellow dot test chart image, green laser corresponding to magenta dot test chart image, red laser corresponding to cyan dot test chart image and admixture of blue, green and red corresponding to black dot test chart image by using laser scan exposure apparatus.

He—Ne laser (544 nm) for green laser, semiconductor laser (AlGaInAs, about 670 nm) for red laser, semiconductor laser (GaAlAs, about 780 nm) for infrared laser were used as the laser light source. The sample was made contact with the rotary drum by suction and image was recorded by main scan and sub scan on rotating drum at 2000 rpm. Exposure value was controlled optimally taking whiteness, maximum density and 2% dot reproduction.

Exposed sample was processed according to the Developing Process-1 mentioned above and image was obtained.

Reproducing property of 2% dot for each image thus obtained was measured by human eyes.

Standard of dot reproduction property by human eyes was classified as 3 ranks.

1. Inferior
2. Normal
3. Good

The result is shown in Table 10.

TABLE 10

| Sample No. | Fluorescent whitening Compound: Compound | Fluorescent whitening Compound: Amount ($g/m^2$) | Dispersion Particle Size | Dot reproduction: Y | Dot reproduction: M | Dot reproduction: C | Remarks |
|---|---|---|---|---|---|---|---|
| 1101 | — | — | — | 2 | 2 | 2 | Comparative |
| 1102 | W-1 | 0.3 | — | 1 | 2 | 2 | Comparative |
| 1103 | F-10 | 0.3 | 0.5 | 3 | 3 | 3 | Inventive |
| 1104 | F-5 | 0.3 | 0.8 | 3 | 3 | 3 | Inventive |
| 1105 | F-12 | 0.3 | 0.5 | 3 | 3 | 3 | Inventive |
| 1106 | F-16 | 0.3 | 0.7 | 3 | 3 | 3 | Inventive |
| 1107 | F-17 | 0.3 | 0.8 | 3 | 3 | 3 | Inventive |

The results shown in Table 10 illustrate that the silver halide light sensitive photographic material of the invention is proved to show excellent 2% dot reproduction of yellow (Y), magenta (M), and cyan (C), and especially effective improvement in yellow (Y) of improved dot reproduction and sharpness. Yellow layer is sensitive in infrared region.

Example 12

On both sides of paper pulp whose weight was 180 $g/m^2$, high density polyethylene was laminated so that a paper support was prepared. On a side in which an emulsion layer was coated, molten polyethylene containing anatase type titanium oxide in which its surface has been processed was dispersed in the content of 15 wt % so that a reflective support was prepared. This reflective support was subjected to corona discharge, and then a gelatin subbing layer was prepared.

The coating composition was prepared in the following manner.

Coating composition for the first layer

To 23.4 g of a yellow coupler (Y-1), 3.34 g of dye image stabilizer (ST-1), 3.34 g of (ST-2), 3.34 g of (ST-5), 0.34 g of anti-stain agent (HQ-1), 5.0 g of image stabilizer A, 5.0 g of a high boiling organic solvent (DBP) and 1.67 g of a high boiling organic solvent (DNP), 60 ml of ethyl acetate was added to be dissolved. Using a ultrasonic homogenizer, the above-mentioned composition was emulsified and dispersed in a 220 ml of 10% aqueous gelatin solution containing 7 ml of a 20% surfactant (SU-1) so that a yellow coupler dispersed composition was prepared. This dispersed composition was mixed with a blue sensitive silver halide emulsion prepared under the following conditions so that a coating composition for the second layer was prepared.

The 2nd through 7th layer

The coating compositions for the 2nd layer through 7th layer were also prepared in the same manner as in the coating composition for the first layer having an amount as shown in Tables 11 and 12.

Hardener H-1 and H-2 were added. As a coating aid, surfactants (SU-2) and (SU-3) were added for regulating surface tension.

TABLE 11

| Layer | Composition | Amount ($g/m^2$) |
|---|---|---|
| 7th layer (Protective layer) | Gelatin | 1.00 |
| | DBP | 0.002 |
| | DIDP | 0.002 |
| | Silicon dioxide | 0.003 |
| 6th layer (UV ray absorption layer) | Gelatin | 0.40 |
| | AI-1 | 0.01 |
| | UV absorber (UV-1) | 0.12 |
| | UV absorber (UV-2) | 0.04 |
| | UV absorber (UV-3) | 0.16 |
| | Anti-stain agent (HQ-5) | 0.04 |
| | PVP | 0.03 |
| 5th layer (Red sensitive layer) | Gelatin | 1.30 |
| | Red sensitive silver bromochloride emulsion (Em-R) | 0.21 |
| | Cyan coupler (C-1) | 0.25 |
| | Cyan coupler (C-2) | 0.08 |
| | Dye image stabilizer (ST-1) | 0.10 |
| | Anti-stain agent (HQ-1) | 0.004 |
| | DBP | 0.10 |
| | DQP | 0.20 |
| 4th layer (UV ray absorption layer) | Gelatin | 0.94 |
| | UV absorber (UV-1) | 0.28 |
| | UV absorber (UV-2) | 0.09 |
| | UV absorber (UV-3) | 0.38 |
| | AI-1 | 0.02 |
| | Anti-stain agent (HQ-5) | 0.10 |
| 3rd layer (Green sensitive layer) | Gelatin | 1.30 |
| | AI-2 | 0.01 |
| | Green sensitive silver bromochloride emulsion (Em-G) | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |

TABLE 12

| Layer | Composition | Amount ($g/m^2$) |
|---|---|---|
| 2nd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.04 |
| | DBP | 0.02 |
| 1st layer (Blue sensitive layer) | Gelatin | 1.20 |
| | Blue sensitive silver bromochloride emulsion (Em-B) | 0.26 |
| | Yellow coupler (Y-1) | 0.70 |
| | Dye image stabilizer (ST-1) | 0.10 |
| | Dye image stabilizer (ST-2) | 0.10 |
| | Anti-stain agent (HQ-1) | 0.01 |
| | Dye image stabilizer (ST-5) | 0.10 |
| | Image stabilizer A | 0.15 |
| | DNP | 0.05 |
| | DBP | 0.15 |
| Support | Polyethylene laminated paper (containing fine amount of coloring agent) | |

Amount of silver halide emulsion was represented in conversion to silver.

A sample prepared in the above-mentioned manner was defined to be Sample 1201.

Then, Samples 1202 to 1204 were prepared in the same manner as in Sample 1201 except that the water soluble fluorescent whitening agent W-1 mentioned in Example 1 was added in the second layer.

The amount of the water soluble fluorescent whitening agent W-1 was 0.1 $g/m^2$ for Sample 1202, 0.2 $g/m^2$ for Sample 1203 and 0.5 $g/m^2$ for Sample 1204.

In addition, Samples 1205 to 1207 were prepared in the same way as Sample 1201 except that the oil soluble fluorescent whitening agent W-2 was added in the second layer as dispersion liquid prepared by the following emulsifying dispersion method.

The amount of the oil soluble fluorescent whitening agent W-2 was 0.1 g/m$^2$ for Sample 1205, 0.2 g/m$^2$ for Sample 1206 and 0.5 g/m$^2$ for Sample 1207.

Method of emulsifying dispersion of oil soluble fluorescent whitening agent W-2

Oil soluble fluorescent whitening agent W-2 in amount of 40 g dissolved in 80 g of dioctylphthalate and 100 ml of ethylacetate was mixed with 7% gelatin solution to which 20 ml of 10% surfactant SU-1 was added at 50° C., and then was emulsified by use of mantongauring homogenizer. Finally water was added to the resulted dispersion to be 1000 ml to obtain dispersion of oil soluble fluorescent whitening agent W-2.

Average particle size of oil drops of the obtained emulsified dispersion was 0.2 $\mu$m.

Samples 1208 to 1210 were prepared in the same way as Sample 121 except that the exemplified compound according to the invention F-10 was added in the second layer as solid particles dispersion liquid prepared by the following solid particles dispersion method.

The amount of the exemplified compound according to the invention F-10 was 0.1 g/m$^2$ for Sample 1208, 0.2 g/m$^2$ for Sample 1209 and 0.5 g/m$^2$ for Sample 1210.

Method of solid fine particles dispersion of the exemplified compound according to the invention F-10

Exemplified compound according to the invention F-10 in amount of 200 g was added to 750 ml of deionized water, then 30 ml of 10% nonionic surfactant polyoxyethylene(10 mol adducted)nonylphenylether solution was added thereto. The temperature was regulated at 40° C., and then the mixture was dispersed at 8000 rpm for 60 minutes by use of high-speed agitating dispersion machine. Finally water was added to the resulted dispersion to be 1000 ml to obtain solid fine particles dispersion liquid of F-10.

Average particle size of the obtained solid fine particles was 0.5 $\mu$m.

In addition, Samples 1211 to 1223 were prepared in the same way as Sample 1209 except that the exemplified compound F-10 was replaced by the compound according to the invention having the average particle size shown in Table 13.

The following evaluation was performed for the samples 1201–1223 thus prepared.

Evaluation of whiteness

Unexposed samples were processed by the following Development Process A to prepare evaluation samples.

Reflective density of each sample was measured by a color analyzer (Model 607, product by Hitachi Ltd.)

Reflective density at wave length of 440 nm ($D_{440}$) and bright value (L*) were measured for the standard of whiteness.

The smaller value of the reflective density $D_{440}$ and the larger value of the bright value (L*) show better characteristics.

The result is shown in Table 13.

TABLE 13

| | Fluorescent whitening Compound | | | Whiteness | | |
|---|---|---|---|---|---|---|
| Sample No. | Compo und | Amount (g/m$^2$) | Dispersion Particle Size | Reflective Density $D_{440}$ | Bright Value L* | Remarks |
| 1201 | — | — | — | 0.095 | 90.04 | Comparative |
| 1202 | W-1 | 0.1 | — | 0.091 | 90.09 | Comparative |
| 1203 | W-1 | 0.2 | — | 0.090 | 90.12 | Comparative |
| 1204 | W-1 | 0.5 | — | 0.089 | 90.14 | Comparative |
| 1205 | W-2 | 0.1 | 0.2 Oil drop | 0.086 | 90.18 | Comparative |
| 1206 | W-2 | 0.2 | 0.2 Oil drop | 0.085 | 90.18 | Comparative |
| 1207 | W-2 | 0.5 | 0.2 Oil drop | 0.090 | 90.00 | Comparative |
| 1208 | F-10 | 0.1 | 0.5 | 0.072 | 90.45 | Inventive |
| 1209 | F-10 | 0.2 | 0.5 | 0.066 | 90.53 | Inventive |
| 1210 | F-10 | 0.5 | 0.5 | 0.058 | 90.58 | Inventive |
| 1211 | F-1 | 0.2 | 0.8 | 0.075 | 90.44 | Inventive |
| 1212 | F-2 | 0.2 | 0.7 | 0.075 | 90.44 | Inventive |
| 1213 | F-5 | 0.2 | 0.5 | 0.074 | 90.43 | Inventive |
| 1214 | F-6 | 0.2 | 0.6 | 0.078 | 90.33 | Inventive |
| 1215 | F-7 | 0.2 | 1.1 | 0.080 | 90.30 | Inventive |
| 1216 | F-8 | 0.2 | 0.4 | 0.067 | 90.51 | Inventive |
| 1217 | F-12 | 0.2 | 0.5 | 0.067 | 90.52 | Inventive |
| 1218 | F-14 | 0.2 | 0.5 | 0.067 | 90.51 | Inventive |
| 1219 | F-15 | 0.2 | 0.8 | 0.069 | 90.50 | Inventive |
| 1220 | F-16 | 0.2 | 0.7 | 0.069 | 90.50 | Inventive |
| 1221 | F-17 | 0.2 | 0.5 | 0.068 | 90.51 | Inventive |
| 1222 | F-18 | 0.2 | 0.3 | 0.068 | 90.52 | Inventive |
| 1223 | F-20 | 0.2 | 0.5 | 0.067 | 90.52 | Inventive |

The results shown in Table 13 illustrate that the silver halide light sensitive photographic material of the invention is proved to show excellent whiteness having high fluorescent effect $D_{440}$ and improved in bright value.

Example 13

Whiteness was evaluated for samples 1201 to 1223 mentioned in the Example 12 with proviso that they were process according to Developing Process B in place of Developing Process A.

The result is shown in Table 14.

TABLE 14

| Sample No. | Whiteness: Reflective Density $D_{440}$ | Whiteness: Bright Value L* | Remarks |
|---|---|---|---|
| 1201 | 0.106 | 90.11 | Comparative |
| 1202 | 0.100 | 90.15 | Comparative |
| 1203 | 0.099 | 90.16 | Comparative |
| 1204 | 0.098 | 90.18 | Comparative |
| 1205 | 0.089 | 90.29 | Comparative |
| 1206 | 0.088 | 90.30 | Comparative |
| 1207 | 0.094 | 90.10 | Comparative |
| 1208 | 0.073 | 90.54 | Inventive |
| 1209 | 0.068 | 90.63 | Inventive |
| 1210 | 0.060 | 90.67 | Inventive |
| 1211 | 0.079 | 90.52 | Inventive |
| 1212 | 0.078 | 90.53 | Inventive |
| 1213 | 0.078 | 90.52 | Inventive |
| 1214 | 0.081 | 90.43 | Inventive |
| 1215 | 0.082 | 90.40 | Inventive |
| 1216 | 0.069 | 90.60 | Inventive |
| 1217 | 0.070 | 90.62 | Inventive |
| 1218 | 0.070 | 90.63 | Inventive |
| 1219 | 0.071 | 90.61 | Inventive |
| 1220 | 0.072 | 90.61 | Inventive |
| 1221 | 0.070 | 90.62 | Inventive |
| 1222 | 0.070 | 90.60 | Inventive |
| 1223 | 0.070 | 90.61 | Inventive |

The results shown in Table 14 illustrate that the silver halide light sensitive photographic material of the invention is proved to show excellent whiteness in case that the fluorescent whitening agent is removed from the processing composition.

Example 14

Samples of the invention is proved to show excellent whiteness evaluated for samples 1201 to 1223 mentioned in the Example 12 with proviso that they were processed according to Developing Process C mentioned in Example 3 in place of Developing Process A.

Example 15

In Example 14, it was observed that the invention was effective in the same whiteness evaluation as Example 12 by the process according to Process CPK-2J1 using NPS-868J (Product by Konica Corporation) as an automatic developing processor and ECOJET-P as processing chemicals.

Example 16

It was observed that the invention was effective in the same whiteness evaluation as Example 12 evaluated for samples 1201 to 1223 mentioned in the Example 12 in case that the fluorescent whitening agent is removed from the processing composition with proviso that they were processed according to Developing Process D mentioned in Example 5 in place of Developing Process A as shown in Example 13.

Effect of the invention

The silver halide photographic light sensitive material is improved in whiteness and bright value after processing, and is excellent in sharpness of image.

What is claimed is:

1. A silver halide light-sensitive photographic material comprising a support having thereon at least one light-sensitive halide emulsion layer and at least one non light-sensitive hydrophilic colloidal layer, wherein at least one of the light-sensitive silver halide emulsion layers or the non light-sensitive hydrophilic colloidal layers contains fine solid particles of a compound exhibiting a fluorescent whitening effect, wherein said compound is a substantially water-insoluble organic salt, represented by the formula (I), (I)

$$A^{n-}n(B^{+})$$

wherein A represents a fluorescent whitening agent component having an anionic group; B represents an organic cation having total carbon atoms of not less than 15, and n represents an integer of 1 to 9.

2. A silver halide light-sensitive photographic material of claim 1 wherein B represents an organic cation represented by formula (III) or formula (IV), (III)

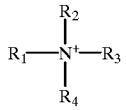

wherein $R_1$, $R_2$, $R_3$, and $R_4$ each represents an alkyl group or a phenyl group, the number of total carbon atoms in $R_1$, $R_2$, $R_3$, and $R_4$ are not less than 15, (IV)

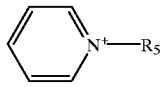

wherein $R_5$ represents an alkyl group or a phenyl group having carbon atoms of not less than 15.

3. A silver halide light-sensitive photographic material of claim 1 wherein the compound exhibiting a fluorescent whitening effect is a substantially water-insoluble organic salt, represented by the formula (II), (II)

$$C^{n-}n(D^{+})$$

wherein C represent a fluorescent whitening agent component having a sulfonic acid group; D represents an organic cation having total carbon atoms of not less than 15, and n represents an integer of 1 to 9.

4. A silver halide light-sensitive photographic material of claim 3 wherein B represents an organic cation represented by formula (III) or formula (IV), (III)

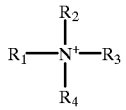

wherein $R_1$, $R_2$, $R_3$, and $R_4$ each represents an alkyl group or a phenyl group, the number of total carbon atoms in $R_1$, $R_2$, $R_3$, and $R_4$ are not less than 15, (IV)

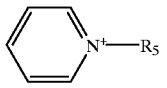

wherein $R_5$ represents an alkyl group or a phenyl group having carbon atoms of not less than 15.

5. The silver halide light-sensitive photographic material of claim 1 wherein said average particle size is 0.2 to 1 $\mu$m.

6. The silver halide light-sensitive photographic material of claim 1 further comprising yellow, magenta, and cyan couplers.

7. A silver halide light-sensitive photographic material comprising a support having thereon at least one light-sensitive halide emulsion layer and at least one non light-sensitive hydrophilic colloidal layer, wherein at least one of the light-sensitive silver halide emulsion layers or the non light-sensitive hydrophilic colloidal layers contains fine solid particles of a compound exhibiting a fluorescent whitening effect, wherein the non light-sensitive hydrophilic colloidal layer is between the support and the light-sensitive silver halide emulsion layer contains white pigment, is nearest the support, and contains said fine solid particles exhibiting a fluorescent whitening effect, there being another non light-sensitive hydrophilic colloidal layer between the support and the non light-sensitive hydrophilic colloidal layer, and the non light-sensitive hydrophilic colloidal layer provided between the support and the non light-sensitive hydrophilic colloidal layer contains white pigment.

8. A silver halide light-sensitive photographic material of claim 1, wherein a nonlight-sensitive hydrophilic colloidal layer is provided between the support and the nonlight-sensitive hydrophilic colloidal layer, and the nonlight-sensitive hydrophilic colloidal layer provided between the support and the nonlight-sensitive hydrophilic colloidal layer contains colloidal silver.

9. A silver halide light-sensitive photographic material of claim 1, wherein light-sensitive silver halide emulsion of the light-sensitive silver halide emulsion layer is spectrally sensitized by infrared spectral sensitizer.

10. A silver halide light-sensitive photographic material of claim 9 wherein the light-sensitive silver halide emulsion layer contains yellow coupler.

* * * * *